US005516040A

United States Patent [19]

Lin

[11] Patent Number: 5,516,040

[45] Date of Patent: May 14, 1996

[54] TWO WAY MAILING ENVELOPES

[76] Inventor: Sheng C. Lin, 64110 Terese Ter., Jamesville, N.Y. 13078

[21] Appl. No.: 191,318

[22] Filed: Feb. 1, 1994

[51] Int. Cl.[6] ..... B65D 27/04; B65D 27/06

[52] U.S. Cl. ..... 229/302; 229/303; 229/306

[58] Field of Search ..... 229/301, 302, 229/303, 304, 305, 306, 80, 75

[56] References Cited

U.S. PATENT DOCUMENTS

| | | | |
|---|---|---|---|
| 886,449 | 5/1908 | West | 229/305 |
| 978,421 | 12/1910 | Wittmann | 229/306 |
| 1,228,146 | 5/1917 | Swift, Jr. | 229/71 |
| 1,373,512 | 4/1921 | Kuhhorn | 229/302 |
| 2,336,025 | 12/1943 | Menlez | 229/80.5 |
| 2,964,233 | 12/1960 | McFarland | 229/302 |
| 3,096,925 | 5/1961 | Hiersteiner . | |
| 3,143,279 | 8/1964 | Black . | |
| 3,270,948 | 9/1966 | Donovan | 229/306 |
| 3,512,702 | 5/1970 | Pritchard, Jr. | 229/80 |
| 4,288,028 | 9/1981 | Diaz | 229/302 |
| 4,308,987 | 1/1982 | Solomon . | |
| 4,332,346 | 6/1982 | Kronman . | |
| 4,445,635 | 5/1984 | Barr | 229/302 |
| 4,565,317 | 1/1986 | Kranz . | |
| 4,595,138 | 6/1986 | Kristel . | |
| 4,602,736 | 7/1986 | Barr . | |
| 4,669,652 | 6/1987 | Seguin . | |
| 4,688,715 | 8/1987 | Barr | 229/302 |
| 4,730,768 | 3/1988 | Grndron . | |
| 4,917,287 | 4/1990 | Watson . | |
| 5,197,663 | 3/1993 | Stude . | |
| 5,224,647 | 7/1993 | Yanow . | |
| 5,271,553 | 12/1993 | Kim | 229/303 |
| 5,271,554 | 12/1993 | Sauerwine . | |
| 5,415,341 | 5/1995 | Diamond | 229/306 |

FOREIGN PATENT DOCUMENTS

| | | | |
|---|---|---|---|
| 163901 | 6/1921 | United Kingdom | 229/305 |
| 583966 | 1/1947 | United Kingdom | 229/80 |

*Primary Examiner*—Stephen P. Garbe
*Attorney, Agent, or Firm*—Barnard, Brown & Michaels

[57] ABSTRACT

The present invention includes a two way envelope that has a front panel, a rear panel, side flaps and a first mailing flap that seals the envelope during the first mailing like any other normal envelope. In addition to these standard features, the envelopes of the present invention include a second mailing flap which folds out to cover a portion of the first mailing information and display second mailing information. The second mailing flap can seal the envelope for the second mailing or a second mailing sealing flap can be provided. The two way envelope differs from the previous two way envelopes primarily in the ease with which the second mailing flap is folded out. The sides of the envelope are closed from the bottom of the envelope to only a portion of the way to the top. The fact that the top portion of the sides are not sealed allows the front and rear panels to be spread apart and the second mailing flap can be removed from between the two panels or the first mailing flap can be inserted with ease. The present invention also includes envelopes that have a second mailing flap or a second sealing flap folded on the outside of the envelope and covered by the first mailing flap during the first mailing. Once the envelope is opened, the second mailing flap or second sealing flap are extremely easy to unfold. In some embodiments, the first mailing information is provided on what would normally look like the rear of the envelope.

10 Claims, 15 Drawing Sheets

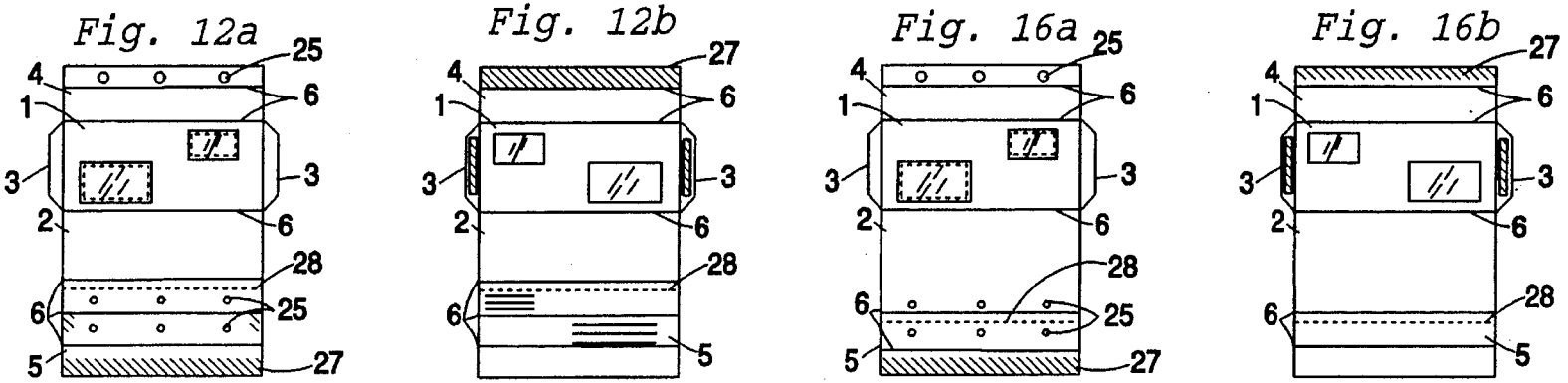
Fig. 12a
Fig. 12b
Fig. 16a
Fig. 16b
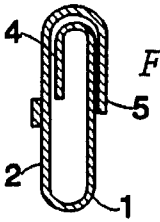
Fig. 14
Fig. 15
Fig. 17
Fig. 18
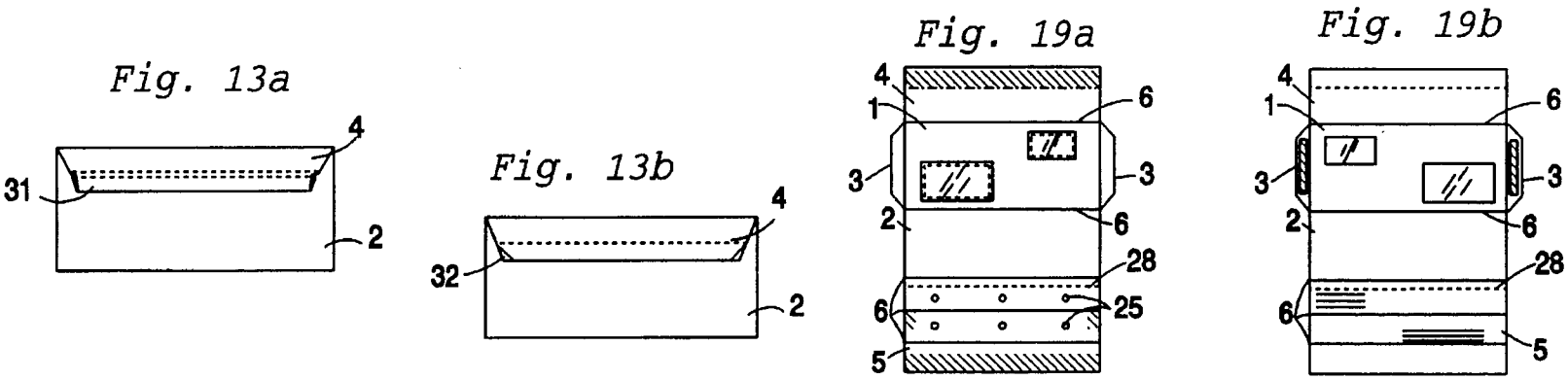
Fig. 13a
Fig. 13b
Fig. 19a
Fig. 19b

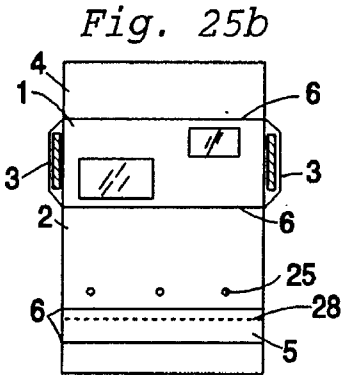
Fig. 21a
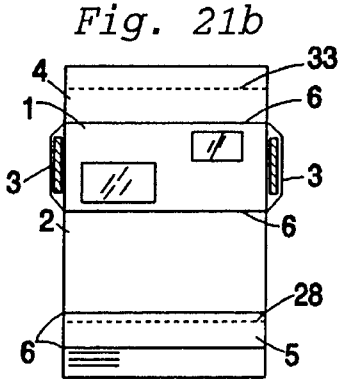
Fig. 21b
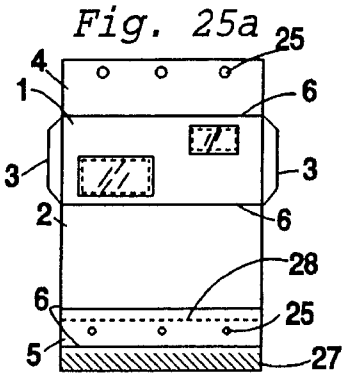
Fig. 25a
Fig. 25b
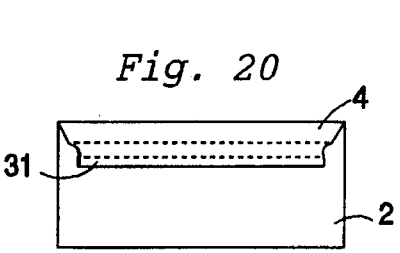
Fig. 20
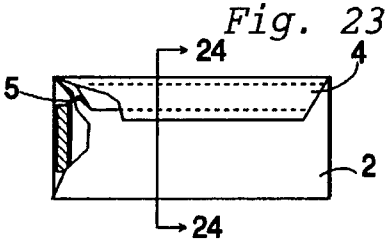
Fig. 23
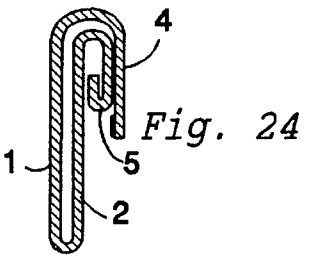
Fig. 24
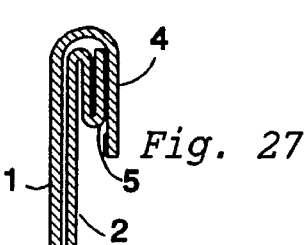
Fig. 27
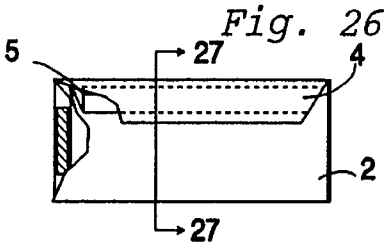
Fig. 26
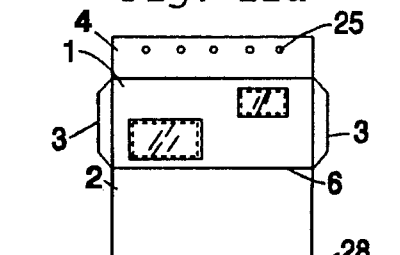
Fig. 22a
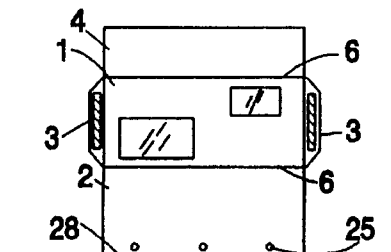
Fig. 22b

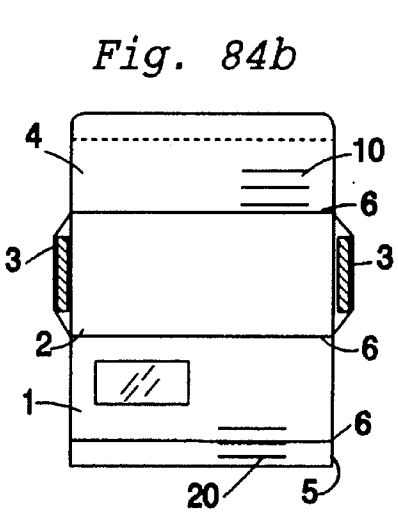
Fig. 84b
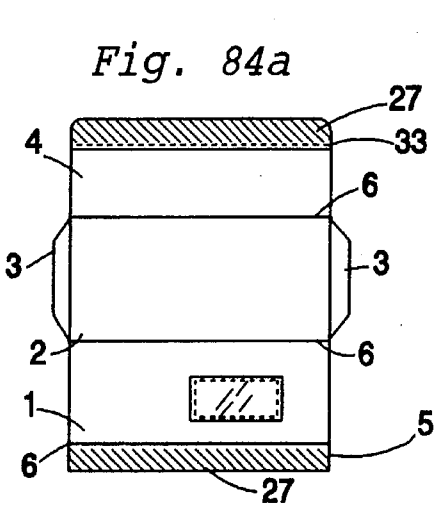
Fig. 84a
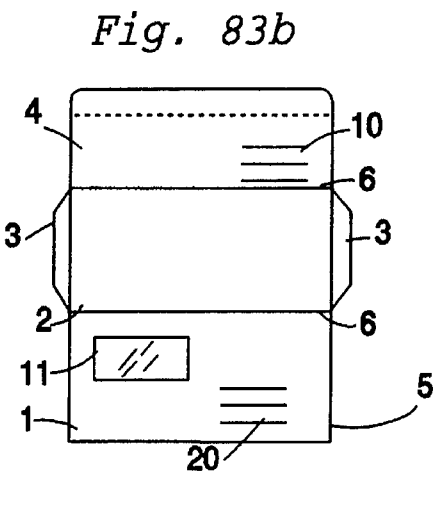
Fig. 83b
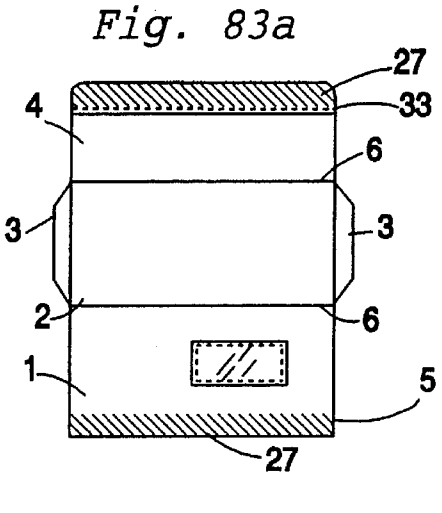
Fig. 83a
Fig. 86b
Fig. 86a
Fig. 85b
Fig. 85a

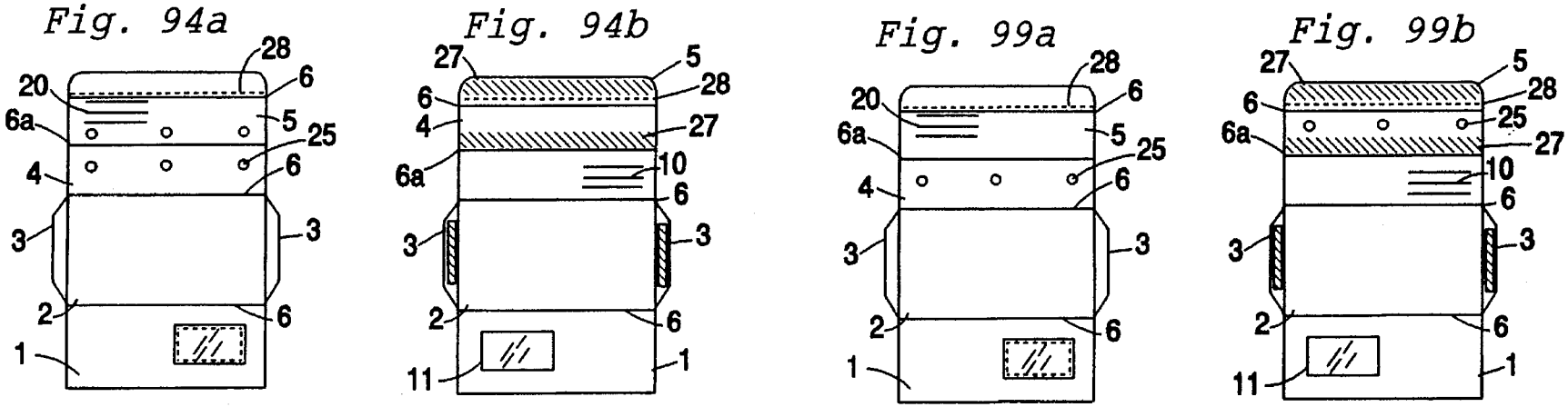
Fig. 99b
Fig. 99a
Fig. 94b
Fig. 94a
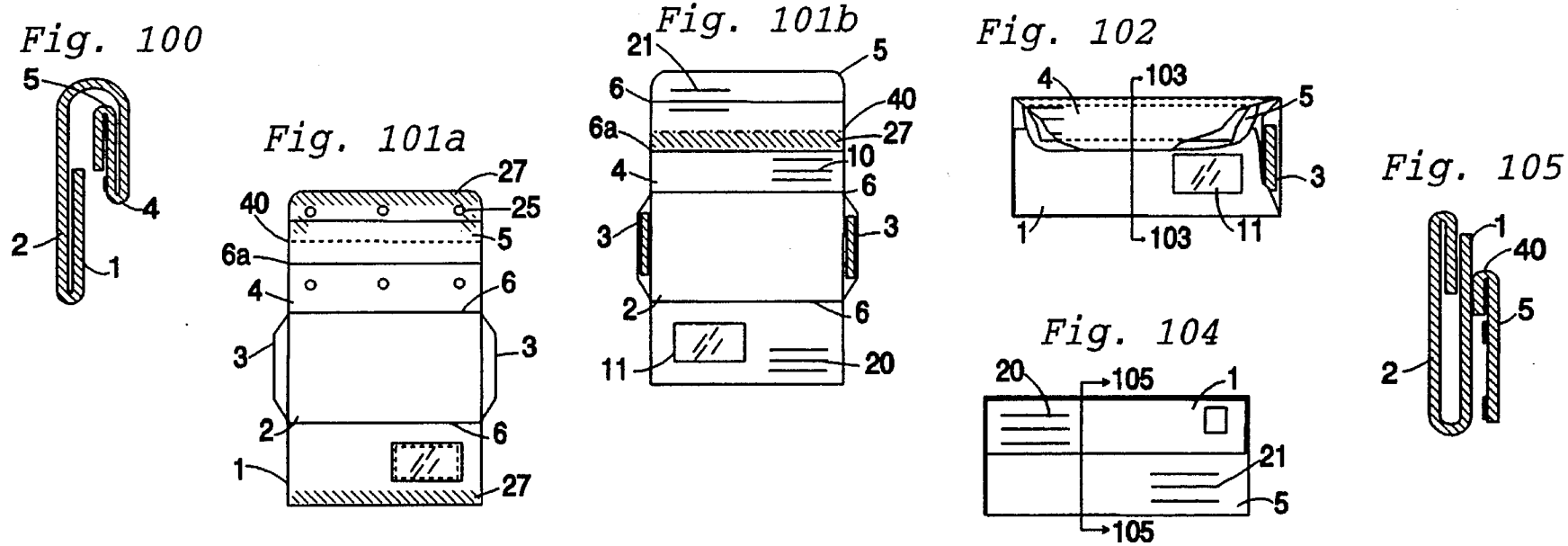
Fig. 105
Fig. 102
Fig. 104
Fig. 101b
Fig. 101a
Fig. 100

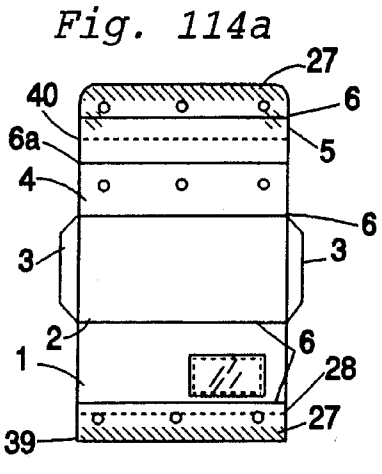
Fig. 114a
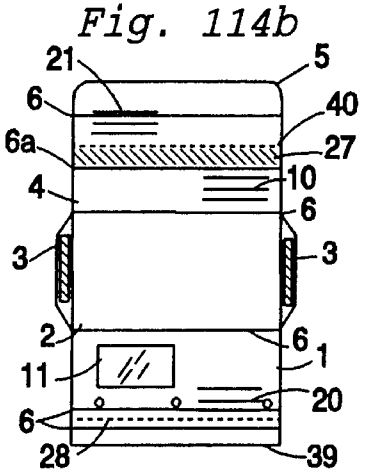
Fig. 114b
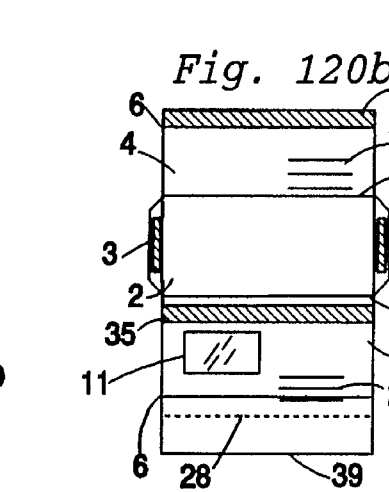
Fig. 120a
Fig. 120b
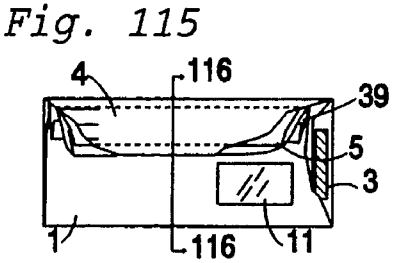
Fig. 115
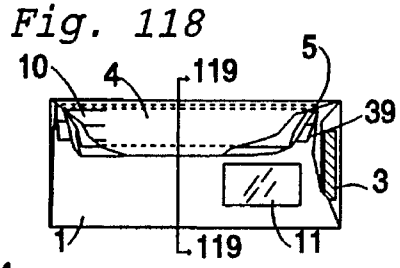
Fig. 118
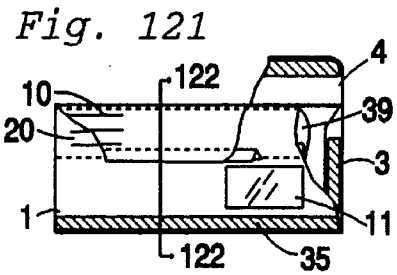
Fig. 121
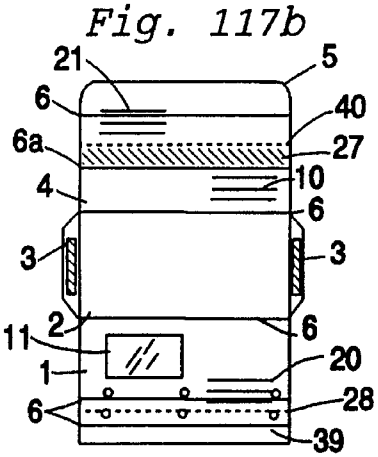
Fig. 117b
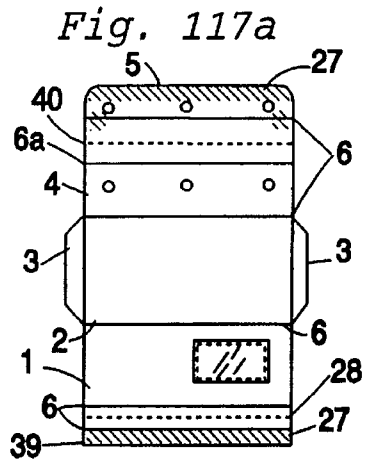
Fig. 117a

TWO WAY MAILING ENVELOPES

FIELD OF THE INVENTION

The invention pertains to the field of two way mailing envelopes. More particularly, the invention pertains to two way mailing envelopes that include a fold out second mailing flap that provides the proper return information for mailing while the first mailing information is no longer shown on the outside of the envelope.

BACKGROUND OF THE INVENTION

Over the years many remailable or two way envelopes have been designed. However, the majority of the businesses with a need for receiving return mail still provide separate return envelopes for their customers.

There is a greater awareness concerning the conservation of resources and reduction of waste such that many companies are voluntarily making efforts to reduce waste and use resources more efficiently. Therefore, the lack of more wide spread use of two way envelopes is surprising and most likely related to the increased cost and difficulty of use of previously designed two way envelope.

Prior envelopes with second mailing flaps are often difficult to use or can not be used with standard postal equipment (e.g. bar code readers) or office equipment (e.g.) letter openers.

U.S. Pat. No. 3,096,925 teaches a two way envelope that is sealed for a first mailing by a removable tab on an extension from the back of the envelope. Once the tab is removed the extension from the back can be brought further down the front by folding the front and back of the envelope at a lower line across the top. This envelope has many disadvantages. The envelope would be rendered useless if a standard letter opener were used. The user must place the initial address high up near the top of the envelope so that it is covered during the second mailing. This is contrary to standard practice and would be not be usable with bar code scanning techniques.

U.S. Pat. No. 4,308,987 teaches a two way envelope that includes a second mailing panel that is attached to the back of the envelope and stuffed inside the envelope during the first mailing. After the first mailing, the second mailing flap is removed and folded over the first mailing information. The sides of the second mailing flap are contoured to allow removal. Even so, the second mailing flap of this type of envelope is extremely difficult to remove without damage. The flap does not cover the entire front of the envelope. Depending upon how the first user positions the return address, some portion of it may show on the outside of the envelope during the second mailing. U.S. Pat. No. 4,332,346 is similar to the envelope taught in U.S. Pat. No. 4,308,987, however, it also teaches providing a spot of glue to prevent the return flap from rising up prematurely and being cut by a letter opener. The glue makes the second mailing flap even more difficult to remove.

U.S. Pat. Nos. 4,565,317, 4,595,138, 4,730,768, 5,197,663 and 5,224,647 all two way envelopes that include a second mailing panel that is attached to the back of the envelope and stuffed inside the envelope during the first mailing. After the first mailing, the second mailing flap is removed and folded over the first mailing information. In some embodiment the sides of the second mailing flap are contoured to allow removal, in others the flap is folded. Even so, the second mailing flap of this type of envelope is extremely difficult to remove without damage. All of these designs are deficient in that they do not provide a second mailing flap that is extremely easy to fold out and secure.

SUMMARY OF THE INVENTION

Therefore, it is the primary object of the present invention to provide envelopes that include a second mailing flap that is easy to fold out and secure to prepare the envelope for a second mailing.

The present invention includes a two way envelope that has a front panel, a rear panel, side flaps and a first mailing flap that seals the envelope during the first mailing like any other normal envelope. In addition to these standard features, the envelopes of the present invention include a second mailing flap which folds out to cover a portion of the first mailing information and display second mailing information. The second mailing flap can seal the envelope for the second mailing or a second mailing sealing flap can be provided.

The two way envelope differs from the previous two envelopes primarily in the ease with which the second mailing flap is folded out. The sides of the envelope are closed from the bottom of the envelope to only a portion of the way to the top. The fact that the top portion of the sides are not glued allows the front and rear panels to be spread apart and the second mailing flap can be removed from inside the envelope or the first mailing flap can be inserted with ease.

The present invention also includes envelopes that have a second mailing flap or a second sealing flap folded on the outside of the envelope and covered by the first mailing flap during the first mailing. Once the envelope is opened, the second mailing flap or second sealing flap are extremely easy to unfold. In some embodiments, the first mailing information is provided on what would normally look like the rear of the envelope.

Further objects and advantages will be seen from the following detailed description taken in conjunction with the drawings.

BRIEF DESCRIPTION OF THE DRAWING

FIGS. 12*a* and 12*b* show the inside and outside of Example 3 of a two way envelope that has a second mailing flap folded inside the envelope during the first mailing.

FIGS. 13*a* and 13*b* show cut away views of a two way envelope that has a first mailing flap that includes a tear strip and a notch respectively.

FIG. 14 is a cross sectional view that shows the second mailing flap of folded up during the first mailing.

FIG. 15 is a cross sectional view that shows the second mailing flap folded out during the second mailing.

FIGS. 16*a* and 16*b* show the inside and outside of Example 4 of a two way envelope that has a second mailing flap folded inside the envelope during the first mailing.

FIG. 17 is a cross sectional view that shows the second mailing flap of folded up during the first mailing.

FIG. 18 is a cross sectional view that shows the second mailing flap folded out during the second mailing.

FIGS. 19*a* and 19*b* show the inside and outside of Example 5 of a two way envelope that has a second mailing flap folded inside the envelope during the first mailing.

FIG. 20 shows a rear view of a two way envelope that has a first mailing flap that includes a perforation string.

FIGS. 21*a* and 21*b* show the inside and outside of Example 6 of a two way envelope that has a second mailing flap folded inside the envelope during the first mailing.

FIGS. 22*a* and 22*b* show the inside and outside of Example 7 of a two way envelope that has a second mailing flap folded outside the envelope and under the first mailing flap during the first mailing.

FIG. 23 is a cut away view of the two way envelope showing the second mailing flap on the outside of the envelope and folded inward toward the envelope.

FIG. 24 is a cross sectional view that shows the second mailing flap folded up during the first mailing.

FIGS. 25*a* and 25*b* show the inside and outside of Example 8 of a two way envelope that has a second mailing flap folded outside the envelope and under the first mailing flap during the first mailing.

FIG. 26 is a cut away view of the two way envelope showing the second mailing flap on the outside of the envelope and folded outward away from the envelope.

FIG. 27 is a cross sectional view that shows the second mailing flap folded up during the first mailing.

FIGS. 83*a* and 83*b* show the inside and outside of Example 27 of a two way envelope that has a second mailing flap that is integrated with the front panel and the first mailing flap includes a perforation and a string.

FIGS. 84*a* and 84*b* show the inside and outside of Example 28 of a two way envelope that has a second mailing flap that is integrated with the front panel and the first mailing flap includes a perforation and a string.

FIGS. 85*a* and 85*b* show the inside and outside of Example 29 of a two way envelope that has a second mailing flap that is integrated with the front panel and the first mailing flap includes a perforation and a string.

FIGS. 86*a* and 86*b* show the inside and outside of Example 30 of a two way envelope that has a second mailing flap that is integrated with the first mailing flap.

FIGS. 94*a* and 94*b* show the inside and outside of Example 32 of a two way envelope that has a second mailing flap that is integrated with the first mailing flap.

FIGS. 99*a* and 99*b* show the inside and outside of Example 33 of a two way envelope that has a second mailing flap that is integrated with the first mailing flap.

FIG. 100 is a cross sectional view through the envelope shown in FIGS. 99*a* and 99*b* that shows the sealed envelope during the first mailing.

FIGS. 101*a* and 101*b* show the inside and outside of Example 34 of a two way envelope that has a second mailing flap that is integrated with the first mailing flap.

FIG. 102 is a cut away view of the two way envelope showing the second mailing flap folded outside the envelope away from the envelope.

FIG. 104 is front view of the two way envelope that has been sealed for the second mailing.

FIG. 105 is a cross sectional view through the envelope shown in FIG. 104 that shows the envelope sealed for the second mailing.

FIGS. 114*a* and 114*b* show the inside and outside of Example 37 of a two way envelope that has a second mailing flap that is integrated with the first mailing flap and a second sealing flap attached to the front panel.

FIG. 115 is a cut away view of the two way envelope showing the second mailing flap folded outside the envelope away from the envelope and the second sealing flap folded outside the envelope away from the envelope.

FIGS. 117*a* and 117*b* show the inside and outside of Example 38 of a two way envelope that has a second mailing flap that is integrated with the first mailing flap and a second sealing flap attached to the front panel.

FIG. 118 is a cut away view of the two way envelope showing the second mailing flap folded outside the envelope away from the envelope and the second sealing flap folded outside the envelope toward the envelope.

FIGS. 120*a* and 120*b* show the inside and outside of Example 39 of a two way envelope that has a second mailing flap that is integrated with the first mailing flap and a second sealing flap attached to the front panel.

FIG. 121 is a cut away view of the two way envelope showing the second sealing flap folded inside the envelope.

Figures 116, 119, 122, 123, 124A, 124B, 125, 126, 128A, 128B, 129, 130:
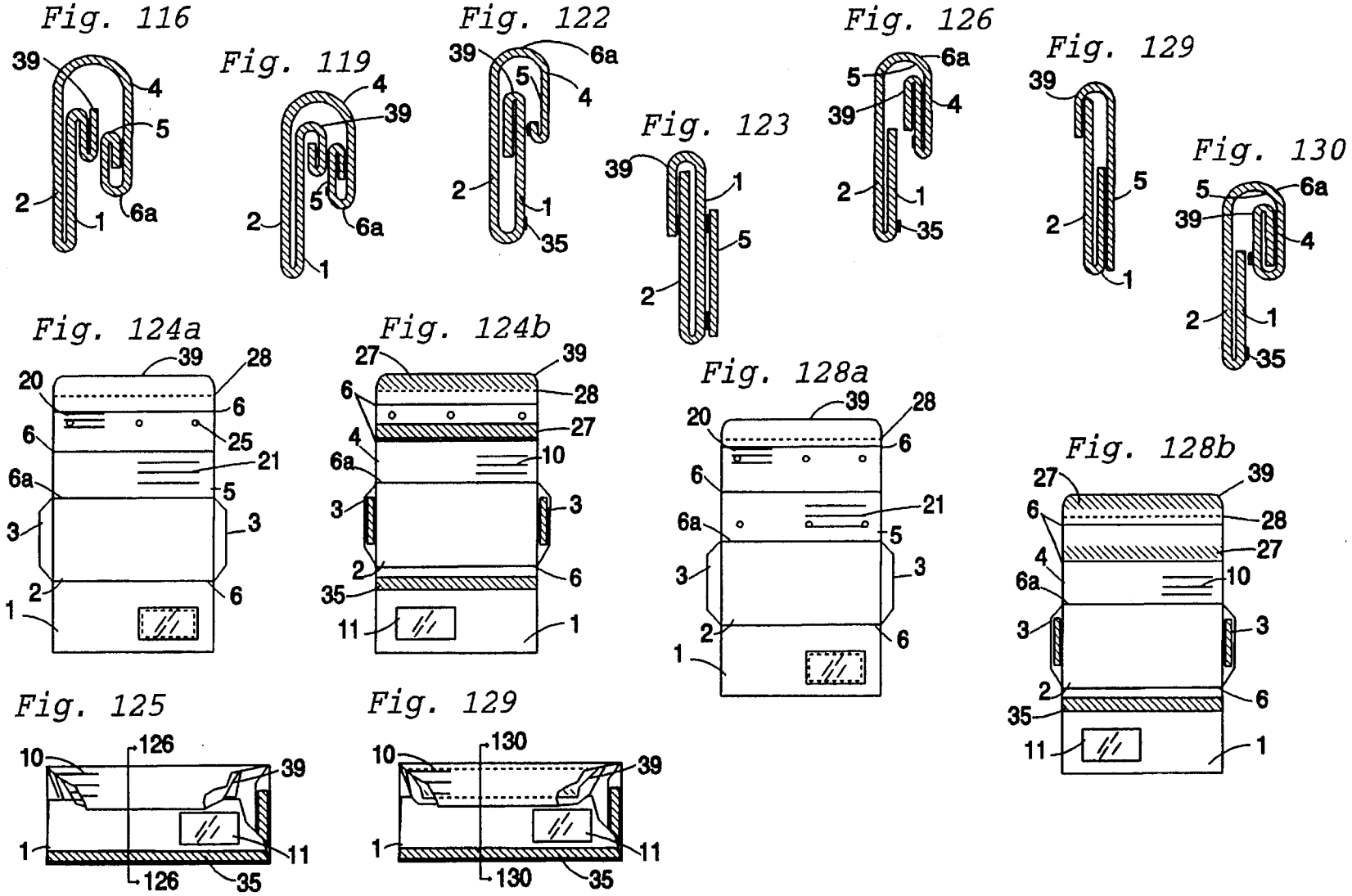
FIG. 116 is a cross sectional view through the envelope shown in FIG. 115 that shows the sealed envelope during the first mailing.
FIG. 119 is a cross sectional view through the envelope shown in FIG. 118 that shows the sealed envelope during the first mailing.

FIG. 122 is a cross sectional view through the envelope shown in FIG. 121 that shows the sealed envelope during the first mailing.

FIG. 123 is a cross sectional view through the envelope shown in FIGS. 120*a* and 120*b* that shows the envelope sealed for the second mailing.

FIGS. 124*a* and 124*b* show the inside and outside of Example 40 of a two way envelope that has a second mailing flap that is integrated with the first mailing flap and a second sealing flap attached to the second mailing flap.

FIG. 125 is a cut away view of the two way envelope showing the second mailing flap and the second sealing flap folded inside the envelope toward the envelope.

FIG. 126 is a cross sectional view through the envelope shown in FIG. 125 that shows the sealed envelope during the first mailing.

FIG. 127 is a cross sectional view through the envelope shown in FIGS. 124*a* and 124*b* that shows the envelope sealed for the second mailing.

FIGS. 128*a* and 128*b* show the inside and outside of Example 41 of a two way envelope that has a second mailing flap that is integrated with the first mailing flap and is attached to a second sealing flap.

FIG. 129 is a cut away view of the two way envelope showing the second mailing flap and the second sealing flap folded inside the envelope away from the envelope.

FIG. 130 is a cross sectional view through the envelope shown in FIG. 129 that shows the sealed envelope during the first mailing.

DESCRIPTION OF THE PREFERRED EMBODIMENT

This detailed descriptions provides forty one different examples of two way envelopes. In general, all of the envelopes can be constructed from a single sheet of paper and figures depicting the inside and outside of each envelope prior to folding are included. In addition, a front view of the sealed envelope during first and second mailings is provided. To provide a better understanding of how the envelope is folded and used a cut away view for each example and cross sectional representations of the sealed envelope during first and second mailings are shown. The examples are similar and therefore, some of the views of the examples look very similar. To avoid duplication of figures, the description refers to views of previously described examples. For clarity, the following table has been provided which lists the figure that shows each view for a particular example.

| Example | Inside & Outside | 1st mail Front view | Cutaway | 1st mail X-section | 2nd mail Front view | 2nd mail X-section |
|---|---|---|---|---|---|---|
| 1 | 1a-b | 2a-c | 3 | 5 | 4 | 6 |
| 2 | 7a-b | 2a-c | 8 | 10 | 9 | 11 |
| 3 | 12a-b | 2a-c | 13a-b | 14 | 4 | 15 |
| 4 | 16a-b | 2a-c | 13a-b | 17 | 9 | 18 |
| 5 | 19a-b | 2a-c | 20 | 5[1] | 4 | 15 |
| 6 | 21a-b | 2a-c | 20 | 10[1] | 9 | 18 |
| 7 | 22a-b | 2a-c | 23 | 24 | 9 | 11 |
| 8 | 25a-b | 2a-c | 26 | 27 | 9 | 11 |
| 9 | 28a-b | 2a-c | 23 | 29 | 9 | 18 |
| 10 | 30a-b | 2a-c | 26 | 31 | 9 | 18 |
| 11 | 32a-b | 2a-c | 33 | 24[1] | 9 | 18 |
| 12 | 34a-b | 2a-c | 35 | 27[1] | 9 | 18 |
| 13 | 36a-b | 37 | 38 | 39 | 40 | 41 |
| 14 | 42a-b | 37 | 43 | 44 | 40 | 41 |
| 15 | 45a-b | 37, 46a-b | 47 | 48 | 49 | 50 |
| 16 | 51a-b | 37, 46a-b | 52 | 53 | 49 | 50 |
| 17 | 54a-b | 55 | 56 | 53[2] | 57 | 58 |
| 18 | 59a-b | 55 | 60 | 48[2] | 57 | 58 |
| 19 | 61a-b | 62a-b | 38 | 39[1] | 49 | 50 |
| 20 | 63a-b | 62a-b | 43 | 44[1] | 49 | 50 |
| 21 | 64a-b | 37 | | 65 | 66 | 67 |
| 22 | 68a-b | 37 | 69 | 70 | 66 | 67 |
| 23 | 71a-b | 37 | 69 | 72 | 40 | 41 |
| 24 | 73a-b | 37, 46a-b | 74 | 75 | 76 | 77 |
| 25 | 78a-b | 37, 46a-b | 79 | 80 | 76 | 77 |
| 26 | 81a-b | 37, 46a-b | 79 | 82 | 49 | 50 |
| 27 | 83a-b | 62a-b | | 65[1] | 76 | 77 |
| 28 | 84a-b | 62a-b | | 70[1] | 76 | 77 |
| 29 | 85a-b | 62a-b | | 72[1] | 49 | 50 |
| 30 | 86a-b | 37, 46a-b | 87 | 88 | 89 | 90 |
| 31 | 91a-b | 37, 46a-b | 92 | 93 | 89 | 90 |
| 32 | 94a-b | 37, 46a-b | 95 | 96 | 97 | 98 |
| 33 | 99a-b | 37, 46a-b | 92 | 100 | 97 | 98 |
| 34 | 101a-b | 37 | 102 | 103 | 104 | 105 |
| 35 | 106a-b | 37 | 107 | 108 | 104 | 105 |
| 36 | 109a-b | 37 | 110 | 111 | 112 | 113 |
| 37 | 114a-b | 37 | 115 | 116 | 112 | 113 |
| 38 | 117a-b | 37 | 118 | 119 | 112 | 113 |
| 39 | 120a-b | 55 | 121 | 122 | 112 | 123 |
| 40 | 124a-b | 55 | 125 | 126 | 4 | 127 |
| 41 | 128a-b | 55 | 129 | 130 | 4 | 127 |

[1]The view looks the same as the listed figure except that the first mailing flap is a little longer to accommodate a perforation and a string.
[2]The view looks the same as the listed figure except that a pressure sensitive glue strip is included on the front panel.

EXAMPLE 1

FIGS. 1*a* through 6 show Example 1 of a two way envelope that has a second mailing flap 5 folded inside the envelope during the first mailing and folds out to cover the entire front panel of the envelope during the second mailing.

Figures 1A, 1B, 2A, 2B, 2C, 3, 4, 5, 6, 7A, 7B, 8, 9, 10, 11:
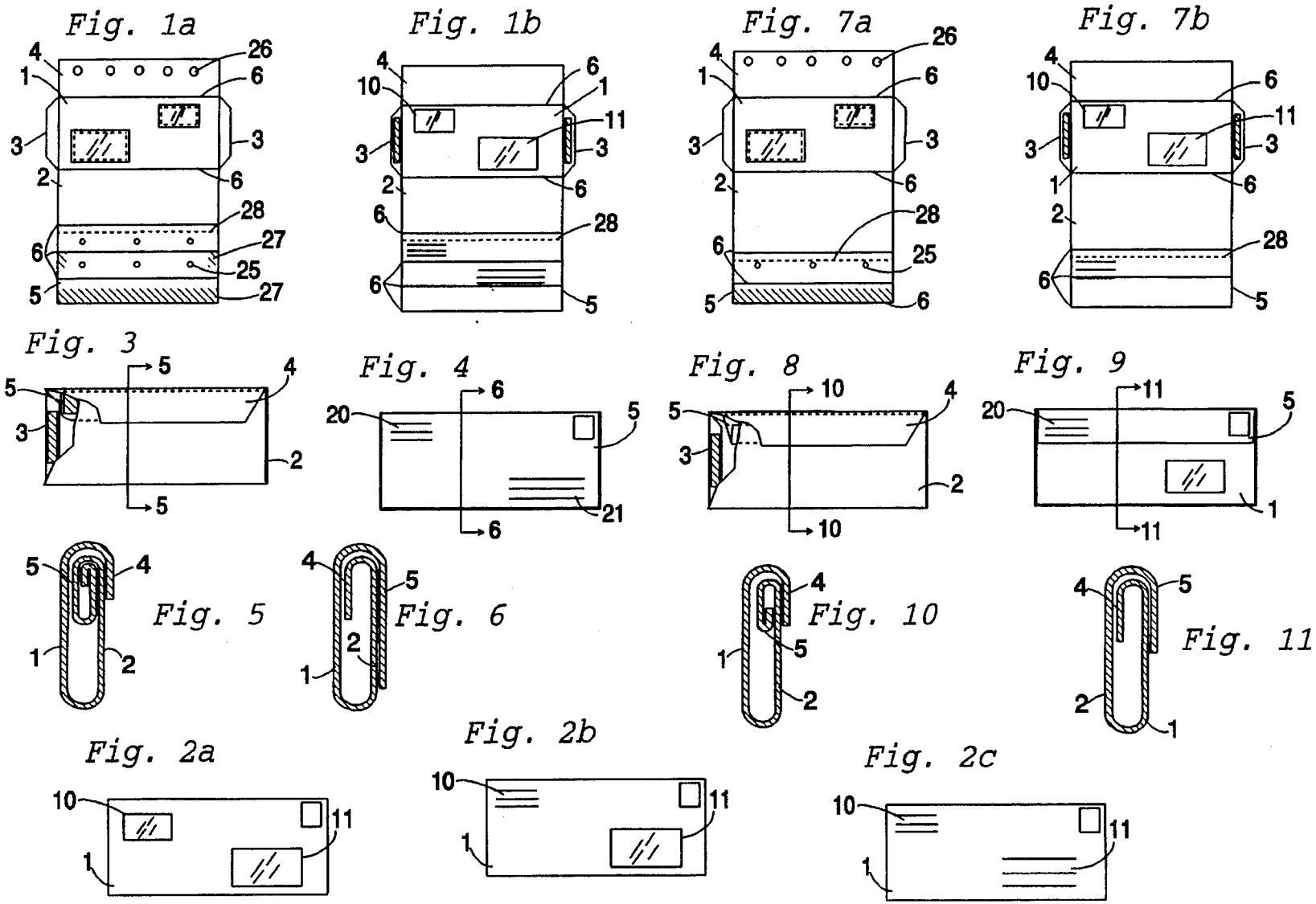
FIGS. 1*a* and 1*b* show the inside and outside of Example 1 of a two way envelope that has a second mailing flap folded inside the envelope during the first mailing.
FIGS. 2*a*, 2*b* and 2*c* show different options for providing the return and forward addressers during the first mailing.
FIG. 3 shows a cut away view of a two way envelope that has a second mailing flap folded inside the envelope during the first mailing and folds out to cover the entire front panel of the envelope.
FIG. 4 shows the front of a two way envelope that has a second mailing flap folded out and covering the entire front panel of the envelope for the second mailing.
FIG. 5 is a cross sectional view through FIG. 3 that shows the second mailing flap folded up during the first mailing.
FIG. 6 is a cross sectional view through FIG. 4 that shows the second mailing flap folded out during the second mailing.
FIGS. 7*a* and 7*b* show the inside and outside of Example 2 of a two way envelope that has a second mailing flap folded inside the envelope during the first mailing.
FIG. 8 shows a cut away view of a two way envelope that has a second mailing flap folded inside the envelope during the first mailing and folds out to cover the return addresser on the front panel of the envelope.
FIG. 9 shows the front of a two way envelope that has a second mailing flap folded out and covering the return addresser on the front panel of the envelope for the second mailing.
FIG. 10 is a cross sectional view through FIG. 8 that shows the second mailing flap folded up during the first mailing.
FIG. 11 is a cross sectional view through FIG. 9 that shows the second mailing flap folded out during the second mailing.

Referring now to FIGS. 1*a* and 1*b*, the inside and outside of a two way envelope are shown respectively. The envelope has a front panel 1, a rear panel 2, and two side extension flaps 3. The envelope is sealed for the first mailing by a first mailing flap 4. A second mailing flap extends from the rear panel 2 of the envelope. In general, the envelopes of the present invention can be made from a single sheet of paper that is folded along the fold lines 6 shown in the figures.

In general, the parts of the two-way envelopes described herein are defined by their respective function rather than their structural location. Therefore it is important to refer to the Figures in conjunction with the description to understand the construction and operation of the two-way envelopes.

The definitions of "front" and "rear" can be a bit confusing with a two-way envelope. Therefore, the "front" of the envelope is always described as the face of the envelope that has the forward addresser during the first mailing. The "rear" of the envelope is merely opposite the "front". The term "first mailing flap" as used herein defines the part of the envelope that is used to seal the envelope during the first mailing. The "second mailing flap" as used herein always refers to a part of the envelope that has second mailing information on it. Therefore, the removable glue spots used to seal the envelope are labeled with reference numeral 26 and the removeable glue spots used to help keep a flap folded are labled with reference numeral 25.

The first mailing return addresser 10 can be provided by a window as shown in FIG. 2*a* or printed on the envelope as shown in FIGS. 2*b* and 2*c*. Likewise the first mailing forwarding addresser 11 can be provided by a window as shown in FIGS. 2*a* and 2*b* or printed on the envelope as shown in FIG. 2*c*. As shown in FIG. 2*b* the two may be combined as the purchaser desires. The windows can have a clear plastic covering or merely be holes in the paper.

The second mailing return addresser 20 and the second mailing forward addresser 21 are shown in FIG. 4 as being preprinted on the second mailing flap 5. The second mailing flap 5 extends from the rear panel with its edge long enough to cover the whole front panel and is folded three times underneath the rear panel during the first mailing as shown in FIGS. 3 and 5.

The side extension flaps 3 are both attached to the front panel. The top edge of the side flaps 3 are cut at an angle to facilitate easy insertion of mail. This taper could be in any desired shape the proper length and degree of the taper will be determined by particular machinery used to stuff envelopes. The side flaps 3 are adhered to the inner face of the rear panel with an unadhered portion at the top. The unadhered portion is a sufficient distance down the side of the envelope to be at least be below the folded second mailing flap 5 as shown in FIG. 3.

The unadhered portion of the side flaps 3 is a very important part of the present invention. It allows the second mailing flap 5 to be removed and the first mailing flap 4 to be stored easily. As can be seen in FIG. 4 the second mailing flap 5 is the full length of the envelope. This would not be possible with prior art envelopes, because they seal the entire side of the envelope. They are forced to provide a narrower second mailing flap. The fact that the second mailing flap 5 can cover the entire front of the envelope will allow the envelope of the present invention to be used in countries like Canada that require that the forwarding and return information not be on the sealing side of the envelope because once the second mailing flap 5 is adhered, both side of the envelope will be smooth and easy to read. If the length of the envelope was extended, the side flaps 3 could be deleted and the front and back panels 1 and 2 could be adhered directly to one another leaving the same unadhered portion as described above.

Any type of glue or adhesive may be used to adhere the side flaps 3. The forward flap 4 could include removable glue in spots 26, as shown in FIG. 1*a*, or in lines on the inner face of the flap 4. The removable glue would allow the envelope to be opened after the first mailing without causing significant damage to the envelope. However, regular adhesives could also be used if the sender anticipated that the receiver would be using a letter opener. The use of a letter opener would not hurt the second mailing flap 5. In fact the forward mailing flap 4 could include a perforation to allow the first mailing flap 4 to be removed after the first mailing.

As mentioned above, the second mailing flap 5 is folded three times along the fold lines 6 during the first mailing. However, once folded out and over the front of the envelope a fold line 28, or a perforation, allows the second mailing flap to fold easily over the front panel 1. The height of the envelope will increase very slightly when the second mailing flap 5 is folded over. The glue or adhesive is on the inner face of the flap.

To assist in holding the second mailing flap 5 during the first mailing, removable glue spots 25 could be added. The glue would pop loose when the second mailing flap 5 was folded out. The glue along the bottom edge and side of the second mailing flap 5 for sealing the envelope during the second mailing could be any appropriate adhesive, e.g. moisture sensitive glue.

EXAMPLE 2

FIGS. 7*a* through 11 show Example 2 of a two way envelope that is very similar to the envelope shown in FIGS. 1*a* through 6, except that the second mailing flap 5 only covers the return addresser 10 and postage area for the first mailing on the front panel 1. FIGS. 7*a* and 7*b* show the inside and outside of the two way envelope. FIG. 8 shows the back of the envelope with the second mailing flap 5 folded twice inside the envelope during the first mailing. FIG. 9 shows the front of the envelope after the second mailing flap 5 has been folded out.

FIG. 10 is a cross sectional view through FIG. 8 that shows the second mailing flap folded up during the first mailing. FIG. 11 is a cross sectional view through FIG. 9 that shows the second mailing flap folded out during the second mailing.

In general, bar code information can be provided for the forward addressers 11 and 21 by either providing a bar code that shows through the window or is preprinted on the envelope, label, or second mailing flap 5. If the second mailing flap 5 does not cover the first mailing forward addresser 11 as shown in FIG. 9, then a window or label is preferable as a forward addresser 21 to provide the bar code information.

The envelopes shown in FIGS. 12*a* through 21*b* are similar to the envelopes shown in FIGS. 1 through 11. The second mailing flap 5 folds into the inside of the envelope and there is an unadhered portion in the sides of the envelopes to allow easy removal. The envelopes differ in the way the envelope is opened after the first mailing and in the length of the second mailing flap 5.

EXAMPLE 3

FIGS. 12*a* and 12*b* show the inside and outside of Example 3 of a two way envelope that has a second mailing flap folded inside the envelope during the first mailing and folds out to cover the entire front panel of the envelope. The first mailing flap 4 includes a fold 6 inward towards the rear panel 2. This fold could alternatively be provided by a fold and perforation. A few spots of glue 25 can be provided to keep the fold tight if desired. After the first mailing the envelope can be opened by separating the first mailing flap 4 along the fold.

FIG. 14 is a cross sectional view, similar to FIG. 5, that shows the second mailing flap folded up during the first mailing. The front and back of the envelope during first mailing would look the same as FIGS. 2*a*–2*c* and FIG. 3 respectively. FIG. 15 is a cross sectional view that shows the second mailing flap folded out during the second mailing, similar to FIG. 6. The second mail front looks the same as the envelope shown in FIG. 4.

EXAMPLE 4

FIGS. 16*a* and 16*b* show the inside and outside of Example 4 of a two way envelope, similar to the envelope shown in FIGS. 12*a* and 12*b*, except that the second mailing only covers the return addresser and the postage area on the front panel of the envelope. The front and back of the envelope during first mailing would look the same as FIGS. 2*a*–2*c* and FIG. 8 respectively. FIG. 17 is a cross sectional view that shows the second mailing flap of folded up during the first mailing, similar to FIG. 10. FIG. 18 is a cross sectional view that shows the second mailing flap folded out during the second mailing, similar to FIG. 11. The second mail front looks the same as the envelope shown in FIG. 9.

To facilitate opening a tear strip 31 can be provided in the folded first mailing flap 4, as shown in FIG. 13*a*. This strip 31 would be cut between two parallel perforations with an end tag to hold onto. Preferably, one of the perforations would be on the fold line 6 between the two levels of the flap 4. As another way of opening the envelope, notches 32 could be provided in each of the lower corners of the top level of the folded first mailing flap 4.

A perforation or a perforation and a string can be added on the fold between the front panel 1 and the first mailing flap 4 to allow the flap 4 to be removed after the first mailing.

EXAMPLES 5 AND 6

FIGS. 19*a*, 19*b*, 21*a* and 21*b* show the inside and outside of Examples 5 and 6 of two way envelopes similar to the envelopes shown in FIGS. 1*a*, 1*b*, 7*a* and 7*b* respectively except that a perforation and a string 33 is provided for opening the envelope after the first mailing and the application of glue is different. The perforation and string 33 could alternatively be provided by a peforation and a paper strip. FIG. 20 shows the back of a two way envelope that has a first mailing flap that includes a perforation and a string 33.

The front and cross sections of the envelope shown if FIGS. 19*a* and 19*b* looks the same as the envelopes shown in FIGS. 2*a*–*c*, FIG. 5 and FIG. 15, except that during the first mailing the first mailing flap 4 would be a little longer to accommodate the perforation and string. The second mail front looks the same as the envelope shown in FIG. 4.

The front and cross sections of the envelope shown in FIGS. 21*a* and 21*b* looks the same as the envelopes shown in FIGS. 2*a*–*c*, FIG. 10 and FIG. 18, except that during the first mailing the first mailing flap 4 would be a little longer to accommodate the perforation and string. The second mail front looks the same as the envelope shown in FIG. 9.

EXAMPLES 7–12

The two way envelopes shown in FIGS. 22*a*–35 are similar to the previous Examples, however, the second mailing flap 5 folds on the outside of the envelope rather than on the inside. In all examples, the first mailing flap 4 covers the second mailing flap 5 during the first mailing. Once the envelope is opened after the first mailing, the second mailing flap 5 is folded out. The second mailing flap 5 covers the return addresser 10 on the front panel 1 of the envelope. During the second mailing the front of the envelope will look like the front of the envelop shown in FIG. 9.

In general, the front of the envelopes during first mailing can look like any of the envelopes shown in FIGS. 2*a* through 2*c*. The first mail return addresser 10 can be preprinted, a label or a window because it is covered. The first mail forward addresser 11 is preferably a window because is it not covered during the second mailing. The correct second mailing forward address could be provided on a return invoice that would show through the window. If the first mailing forward addresser 11 were preprinted on the envelope, a perforation around the forward addresser 11 could be provided on the front panel 1 and to provide the correct forwarding information for the second mailing, the perforated addresser 11 would be removed after the first mailing.

The fold 6 between the front panel 1 and the first mailing flap 4 could include a perforation for separation of the flap 4 during the second mailing. A fold guide 28 can be provided along the second mailing flap 5 to make sealing the envelope for the second mailing easier. The fold guide 28 can be either be a fold or a perforation.

As shown in FIGS. 22*a* through 35, the side flaps 3 are sealed most of the way, but include an unsealed portion to allow the first mailing flap 4 to be tucked inside the envelope for the second mailing. If the first mailing flap 4 were to be severed prior to the second mailing the unsealed portion of the side flaps 3 would not be important. However, the preferred embodiment is to include an unsealed portion.

Even though the second mailing flap 5 folds up on the outside of the envelope, the glue 27 is always hidden from the first mailing flap 4. This is important because if the glue 27 were not hidden from the inner surface of the first mailing flap 4 and excess moisture was applied during the first sealing, the two flaps 4 and 5 would stick together.

EXAMPLE 7

Referring now to FIGS. 22*a* and 22*b*, the inside and outside of Example 7 of a two way envelope that has a second mailing flap 5 folded outside the envelope is shown. The flap is folded twice to hide the glue 27 on the inner surface of the flap 5. FIG. 23 is a cut away view of the two way envelope showing the second mailing flap 5 on the outside of the envelope and folded twice inward toward the envelope. FIG. 24 is a cross sectional view that shows the second mailing flap 5 folded up during the first mailing. When the flap 5 is folded out during the second mailing the envelope will look the same as the envelope shown in FIG. 11. Some removable glue spots 25 are shown on the outer surface of the flap 5 near the fold between the flap 5 and the rear panel 2 to help the folding of the second mailing flap 5.

EXAMPLE 8

FIGS. 25*a* and 25*b* show the inside and outside of Example 8 of a two way envelope that has a second mailing flap 5 folded outside the envelope. FIG. 26 is a cut away view of the two way envelope showing the second mailing flap 5 on the outside of the envelope and folded outward away from the envelope. FIG. 27 is a cross sectional view that shows the second mailing flap 5 folded up during the first mailing. The flap 5 is folded once between the flap 5 and the rear panel 2 and again in the middle of the flap 5. The glue 27 is on the inner surface of the flap 5. When the flap 5 is folded out during the second mailing the envelope will look the same as the envelope shown in FIG. 11. Some removable glue spots 25 are shown on the inner surface of the flap 5 and the outer surface of the rear panel 2 to help the folding of the second mailing flap 5.

EXAMPLE 9

Figure 28B:
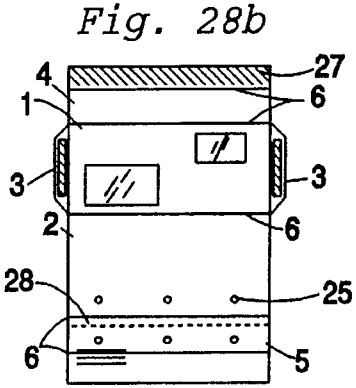
FIGS. 28*a* and 28*b* show the inside and outside of Example 9 of a two way envelope that has a second mailing flap folded outside the envelope and under the first mailing flap during the first mailing.
Figure 28A:
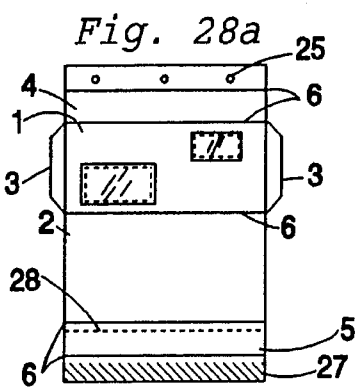
Figure 29:
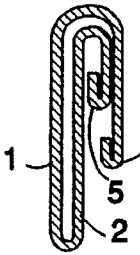
FIG. 29 is a cross sectional view that shows the second mailing flap folded up during the first mailing.

FIGS. 28*a* and 28*b* show the inside and outside of Example 9 of a two way envelope that has a second mailing flap folded outside the envelope similar to FIGS. 22*a* through 24, except that the first mailing flap 4 includes a tear strip 31 or notches 32 (described previously). The rear of the envelope during first mailing would look the same as the envelope shown in FIG. 23 except that a tear strip 31 or notches 32 would be provided as shown in FIGS. 13*a* and 13*b*. FIG. 29 is a cross sectional view that shows the second mailing flap 5 folded up during the first mailing. When the flap 5 is folded out during the second mailing the envelope will look the same as the envelope shown in FIG. 18. Some removable glue spots 25 are shown on the outer surface of the flap 5 and the outer surface of the rear panel 2 to help the folding of the second mailing flap 5.

EXAMPLE 10

Figure 31:
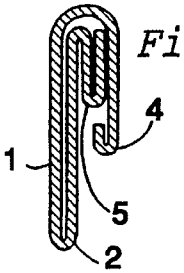
FIG. 31 is a cross sectional view that shows the second mailing flap folded up during the first mailing.
Figure 30B:
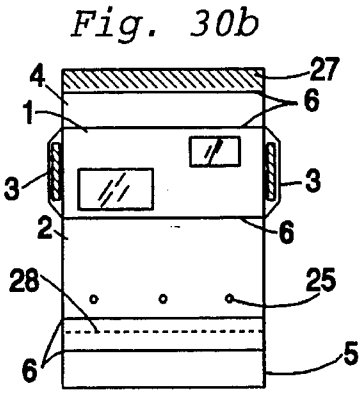
FIGS. 30*a* and 30*b* show the inside and outside of Example 10 of a two way envelope that has a second mailing flap folded outside the envelope and under the first mailing flap during the first mailing.
Figure 30A:
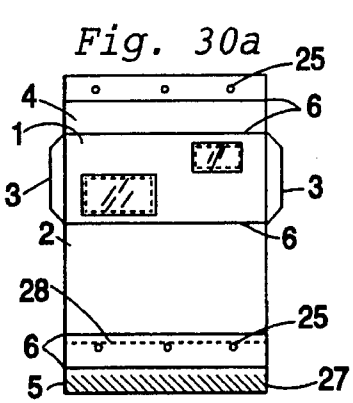

FIGS. 30*a* and 30*b* show the inside and outside of Example 10 of a two way envelope that has a second mailing flap folded outside the envelope similar to FIGS. 25*a* through 27, except that the first mailing flap 4 includes a tear strip 31 or notches 32. The rear of the envelope during first mailing would look the same as the envelope shown in FIG. 26 except that a tear strip 31 or notches 32 would be provided as shown in FIGS. 13*a* and 13*b*. FIG. 31 is a cross sectional view that shows the second mailing flap 5 folded up during the first mailing. When the flap 5 is folded out during the second mailing the envelope will look the same as the envelope shown in FIG. 18. Some removable glue spots 25 are shown on the inner surface of the flap 5 and the lower outer surface of the rear panel 2 to help the folding of the second mailing flap 5.

EXAMPLE 11

Figure 32B:
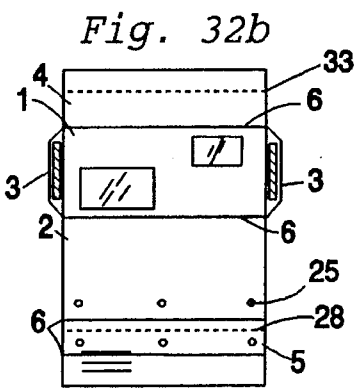
FIGS. 32*a* and 32*b* show the inside and outside of Example 11 of a two way envelope that has a second mailing flap folded outside the envelope and under the first mailing flap during the first mailing.
Figure 32A:
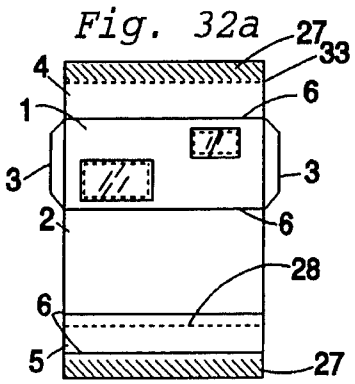
Figure 33:
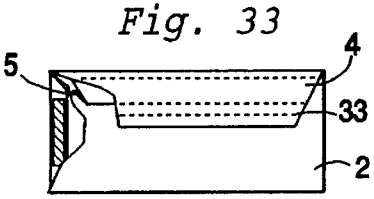
FIG. 33 is a cut away view of the two way envelope showing the second mailing flap on the outside of the envelope and folded inward toward the envelope.

FIGS. 32*a* and 32*b* show the inside and outside of Example 11 of a two way envelope that has a second mailing flap folded outside the envelope similar to FIGS. 22*a* through 24, except that the first mailing flap 4 includes a perforation and a string 33 and the application of glue is different. FIG. 33 is a rear view of the two way envelope showing the second mailing flap 5 on the outside of the envelope and folded inward toward the envelope and the perforation and a string 33. The cross sectional view that shows the second mailing flap 5 folded up during the first mailing looks the same as the envelope shown in FIG. 24 except the first mailing panel 4 would be slightly longer to accommodate the perforation and the string 33. When the flap 5 is folded out during the second mailing the envelope will look the same as the envelope shown in FIG. 18. Some removable glue spots 25 are shown on the outer surface of the flap 5 and the outer surface of the rear panel 2 to help the folding of the second mailing flap 5.

EXAMPLE 12

Figure 35:
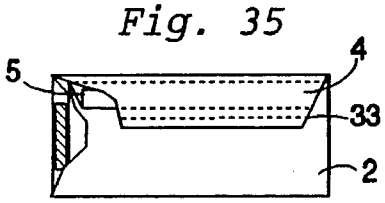
FIG. 35 is a cut away view of the two way envelope showing the second mailing flap on the outside of the envelope and folded outward away from the envelope.
Figure 34B:
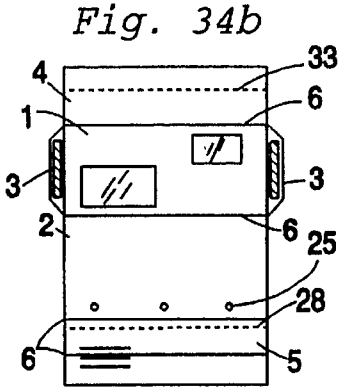
FIGS. 34*a* and 34*b* show the inside and outside of Example 12 of a two way envelope that has a second mailing flap folded outside the envelope and under the first mailing flap during the first mailing.
Figure 34A:
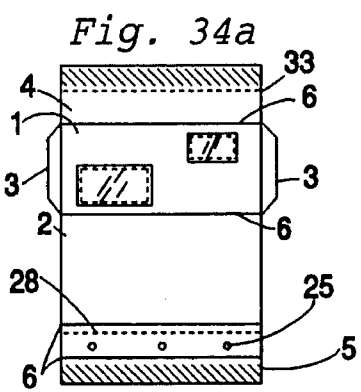

FIGS. 34*a* and 35*b* show the inside and outside of Example 12 of a two way envelope that has a second mailing flap folded outside the envelope similar to FIGS. 25*a* through 27, except that the first mailing flap 4 includes a perforation and a string 33 and the application of glue is different. FIG. 35 is a rear view of the two way envelope showing the second mailing flap 5 on the outside of the envelope and folded outward away from the envelope and the perforation and string 33. The cross sectional view that shows the second mailing flap 5 folded up during the first mailing looks the same as the envelope shown in FIG. 27 except the first mailing panel 4 would be slightly longer to accommodate the perforation and the string 33. Some removable glue spots 25 are shown on the inner surface of the flap 5 and the lower outer surface of the rear panel 2 to help the folding of the second mailing flap 5.

EXAMPLES 13–20

Examples 13 through 20 are similar to Examples 1–12, except that the first mailing return addresser 10 is located on the first mailing flap 4 which is attached to the rear panel 2 and folds over the top of the envelope and attaches to the front panel 1 during the first mailing. The second mailing flap 5 is attached to the front panel 1 and is folded on the outside of the two way envelope and covered by the first mailing flap 4 during the first mailing.

EXAMPLE 13

Figures 36A, 36B, 37, 38, 39, 40, 41, 42A, 42B, 43, 44, 45A, 45B:
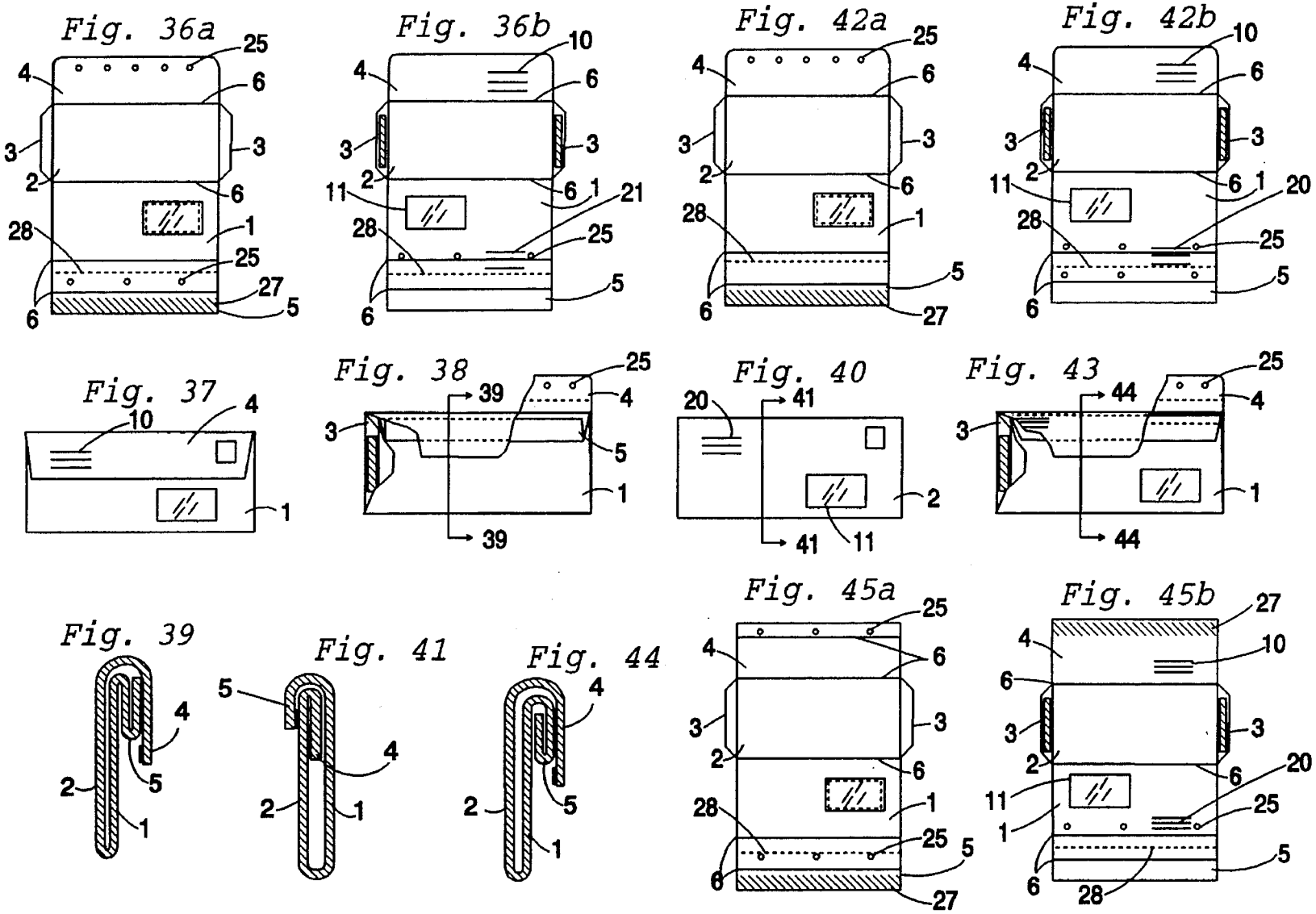
FIGS. 36*a* and 36*b* show the inside and outside of Example 13 of a two way envelope that has a second mailing flap folded outside the envelope on the front side of the envelope.
FIG. 37 is a front view of the two way envelope showing the first mailing return addresser on the front of the first mailing flap.
FIG. 38 is a cut away view of the two way envelope showing the second mailing flap on the outside of the envelope and folded outward away from the envelope.
FIG. 39 is a cross sectional view through the envelope shown in FIG. 38 that shows the second mailing flap folded up during the first mailing.
FIG. 40 is front view of the two way envelope with the second mailing flap folded out for the second mailing.
FIG. 41 is a cross sectional view through the envelope shown in FIG. 40 that shows the second mailing flap folded out for the second mailing.
FIGS. 42*a* and 42*b* show the inside and outside of Example 14 of a two way envelope that has a second mailing flap folded outside the envelope on the front side of the envelope.
FIG. 43 is a cut away view of the two way envelope showing the second mailing flap on the outside of the envelope and folded inward toward the envelope.
FIG. 44 is a cross sectional view through the envelope shown in FIG. 43 that shows the second mailing flap folded up during the first mailing.
FIGS. 45*a* and 45*b* show the inside and outside of Example 15 of a two way envelope that has a second mailing flap folded outside the envelope on the front side of the envelope.

FIGS. 36*a* and 36*b* show the inside and outside of Example 13 of a two way envelope that has a second mailing flap 5 folded outside the envelope on the front side of the envelope. FIG. 37 is a front view of the two way envelope that shows the first mailing return addresser 10 on the front of the first mailing flap 4. FIG. 38 is a cut away view of the two way envelope showing the second mailing flap 5 on the outside of the envelope and folded outward away from the envelope. FIG. 39 is a cross sectional view through the envelope that shows the second mailing flap 5 folded up during the first mailing.

Removable glue in spots 26 or lines is provided on the first mailing flap 4 for sealing the envelope during first mailing. Moisture sensitive glue 27 is provided on the second mailing flap for sealing during the second mailing. Some removable glue spots 25 can be added on the inner and outer surfaces of the second mailing flap 5 to aid in the folding. The second mailing flap 5 is folded twice to hide the glue on the inner surface of the flap 5.

FIG. 40 is front view of the two way envelope with the second mailing flap 5 folded out for the second mailing. The front and rear of the envelope during the second mailing look like a normal one way mailing envelope. FIG. 41 is a cross sectional view through the envelope that shows the second mailing flap 5 folded out for the second mailing. The second mailing flap 5 could include a fold or perforation 28 to allow the flap 5 to fold over the top of the envelope more easily.

EXAMPLE 14

FIGS. 42*a* and 42*b* show the inside and outside of Example 14 of a two way envelope similar to Example 13. FIG. 43 is a front view of the envelope showing the second mailing flap 5 is folded inward toward the envelope as opposed to outward as in Example 13. FIG. 44 is a cross sectional view through the envelope shown in FIG. 43 that shows the second mailing flap folded up during the first mailing. The removable glue spots 25 on the second mailing flap are provided on the outside of the flap 5.

EXAMPLE 15

Figures 46A, 46B, 47, 48, 49, 50, 51A, 51B, 52, 53, 54A, 54B, 55, 56, 57, 58:
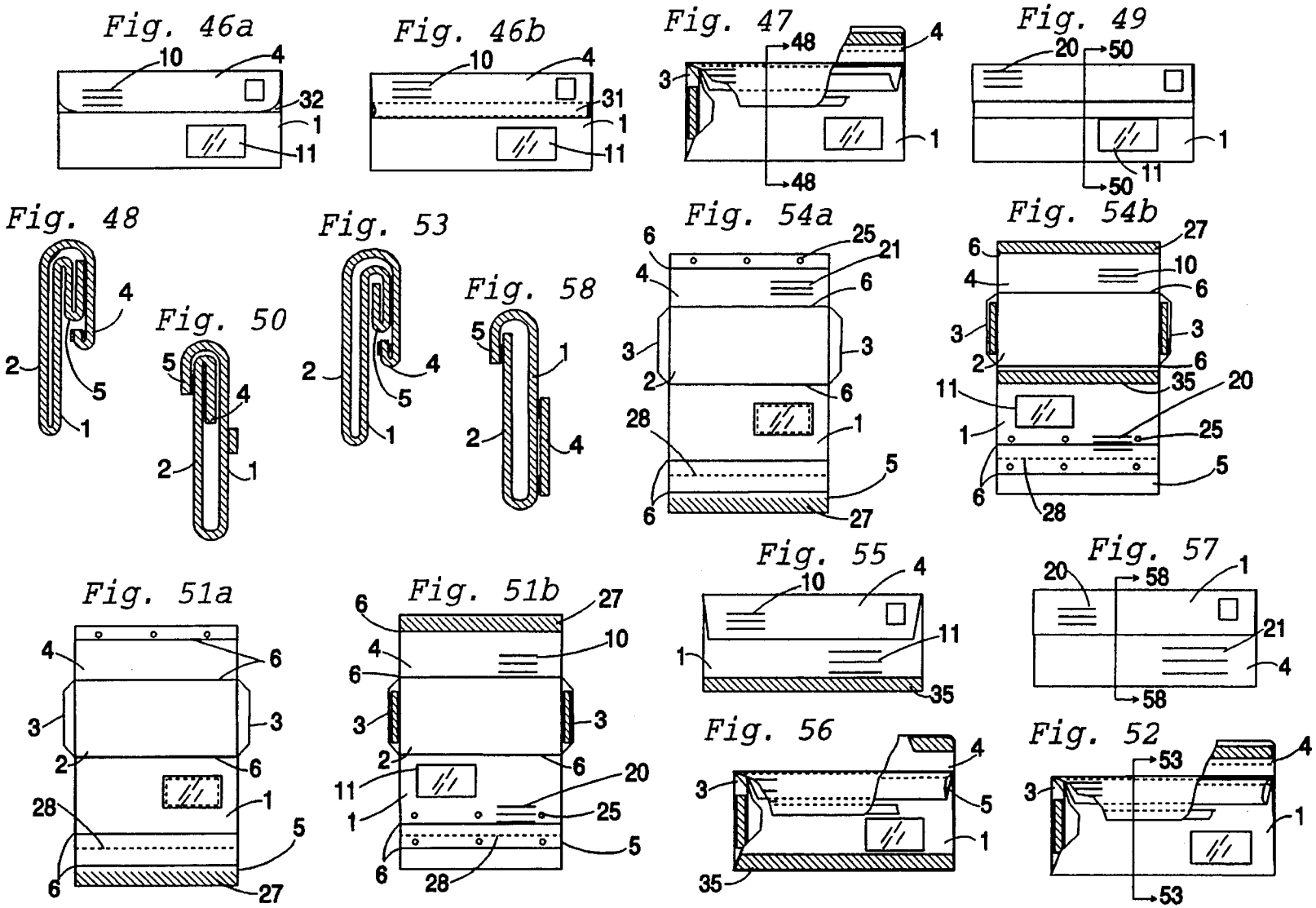
FIGS. 46*a* and 46*b* are front views of the two way envelope showing the first mailing return addresser on the front of the first mailing flap.
FIG. 47 is a cut away view of the two way envelope showing the second mailing flap on the outside of the envelope and folded outward away from the envelope.
FIG. 48 is a cross sectional view through the envelope shown in FIG. 47 that shows the second mailing flap folded up during the first mailing.
FIG. 49 is front view of the two way envelope with the second mailing flap folded out for the second mailing.
FIG. 50 is a cross sectional view through the envelope shown in FIG. 49 that shows the second mailing flap folded out for the second mailing.
FIGS. 51*a* and 51*b* show the inside and outside of Example 16 of a two way envelope that has a second mailing flap folded outside the envelope on the front side of the envelope.
FIG. 52 is a cut away view of the two way envelope showing the second mailing flap on the outside of the envelope and folded outward away from the envelope.
FIG. 53 is a cross sectional view through the envelope shown in FIG. 52 that shows the second mailing flap folded up during the first mailing.
FIGS. 54*a* and 54*b* show the inside and outside of Example 17 of a two way envelope that has a second mailing flap folded outside the envelope on the front side of the envelope.
FIG. 55 is a front view of the two way envelope showing the first mailing return addresser on the front of the first mailing flap and a pressure sensitive sealing strip on the bottom of the front panel.
FIG. 56 is a cut away view of the two way envelope showing the second mailing flap on the outside of the envelope and folded inward toward the envelope.
FIG. 57 is front view of the two way envelope with the second mailing flap folded out and the first mailing flap folded down for the second mailing.
FIG. 58 is a cross sectional view through the envelope shown in FIG. 57 that shows the second mailing flap folded out and the first mailing flap folded down for the second mailing.

FIGS. 45*a* and 45*b* show the inside and outside of Example 15 of a two way envelope similar to Example 13 except that the first mailing flap 4 includes one extra fold line 6 to accommodate the notches or tear strip. FIGS. 46*a* and 46*b* are front views of the envelope showing the first mailing return addresser 10 on the front of the first mailing flap 5 with the optional notches or tear strip. FIG. 47 is a cut away view of the envelope showing the second mailing flap 5 folded outward away from the envelope like Example 13.

FIG. 48 is a cross sectional view through the envelope shown in FIG. 47 that shows the second mailing flap 5 folded up during the first mailing and the extra fold in the first mailing flap 4. The first mailing flap 4 includes moisture sensitive glue 27 on the outside which is then folded over to face the rear panel 2 to seal the envelope. Removable glue spots 25 are provided on the inside to aid in the folding of the flap. The portion of the first mailing flap 4 that include the moisture sensitive glue is not removed from the front of the envelope.

The first mailing flap 4 can be severed in a line parallel to the top edge of the envelope in the middle of the flap 4 or it could be removed entirely by severing it from the rear panel 2. The severance could be accomplished by notches in the flap 4 as shown in FIG. 46*a*, by a tear strip as shown in FIG. 46*b*, or a perforation and a string in the fold in the flap which would make the front look like FIG. 37.

FIG. 49 is front view of the two way envelope with the second mailing flap 5 folded out for the second mailing showing the portion of the first mailing flap 4 that remains attached to the front of the envelope. FIG. 50 is a cross sectional view through the envelope shown in FIG. 49 that shows the second mailing flap 5 folded out for the second mailing.

EXAMPLE 16

FIGS. 51*a* and 51*b* show the inside and outside of Example 16 of a two way envelope that is similar to Example 15 except that the second mailing flap 5 folded inward toward the envelope as opposed to away from the envelope. FIG. 52 is a cut away view of the envelope showing the second mailing flap 5 folded outward away from the envelope. FIG. 53 is a cross sectional view through the envelope shown in FIG. 52 that shows the second mailing flap folded up during the first mailing. Examples 15 and 16 are similar in the same way that FIGS. 13 and 14 are similar including the location of the removable glue spots 25 on the second mailing flap 5.

EXAMPLE 17

FIGS. 54*a* and 54*b* show the inside and outside of Example 17 of a two way envelope similar to Example 16 except that the first mailing flap 4 is severed from the rear panel 2 and folds down to provide the second mailing forward addresser 21. The severed first mailing flap 4 is secured by a pressure sensitive glue strip 35 provided on the bottom of the front panel 1. FIG. 55 is a front view of the envelope showing the pressure sensitive sealing strip 35 on the bottom of the front panel 1. FIG. 56 is a cut away view of the envelope showing the second mailing flap 5 on the outside of the envelope and folded inward toward the envelope. The cross sectional view of FIG. 56 would look like the envelope shown in FIG. 53. The envelope could include a perforation and a string in the fold line 6 between the rear panel 2 and the first mailing flap 4 to allow a clean severance.

FIG. 57 is front view of the envelope with the second mailing flap 5 folded out and the first mailing flap 4 folded down for the second mailing. FIG. 58 is a cross sectional view through the envelope shown in FIG. 57 that shows the second mailing flap 5 folded out and the first mailing flap 4 folded down for the second mailing. The second mailing flap 5 provides the second mailing return addresser 20 and the folded down first mailing flap 4 provides the second mailing forward addresser 21.

EXAMPLE 18

Figures 59A, 59B, 60, 61A, 61B, 62A, 62B, 63A, 63B, 64A, 64B, 66:
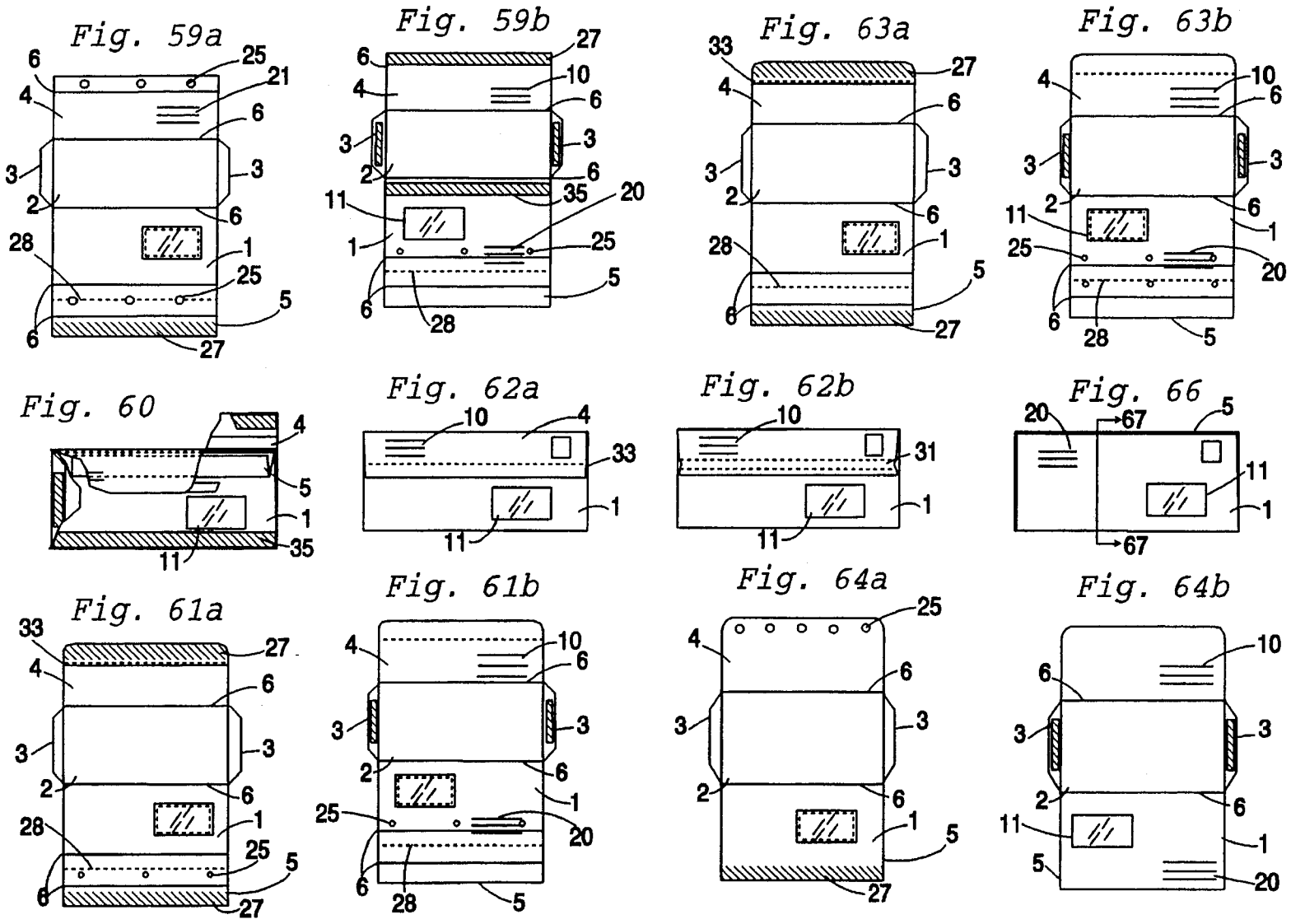
FIGS. 59*a* and 59*b* show the inside and outside of Example 18 of a two way envelope that has a second mailing flap folded outside the envelope on the front side of the envelope.
FIG. 60 is a cut away view of the two way envelope showing the second mailing flap on the outside of the envelope and folded outward away from the envelope and a pressure sensitive sealing strip on the front panel.
FIGS. 61*a* and 61*b* show the inside and outside of Example 19 of a two way envelope that has a second mailing flap folded outside the envelope on the front side of the envelope.
FIGS. 62*a* and 62*b* are front views of the two way envelope showing the first mailing return addresser on the front of the first mailing flap and a perforation and string or a tear strip for opening the envelope.
FIGS. 63*a* and 63*b* show the inside and outside of Example 20 of a two way envelope that has a second mailing flap folded outside the envelope on the front side of the envelope.
FIGS. 64*a* and 64*b* show the inside and outside of Example 21 of a two way envelope that has a second mailing flap that is integrated with the front panel.
FIG. 66 is front view of the two way envelope that has been sealed for the second mailing.

FIGS. 59*a* and 59*b* show the inside and outside of Example 18 of a two way envelope that is similar to Example 17 except that the second mailing flap 5 is folded outward away from the envelope as opposed to inward toward the envelope. FIG. 60 is a cut away view of the envelope showing the second mailing flap 5 folded inward toward the envelope and the pressure sensitive glue strip 35. The cross sectional view through FIG. 60 would look the same as the envelope shown in FIG. 48. Examples 17 and 18 are similar in the same way that FIGS. 16 and 15 are similar including the location of the removable glue spots 25 on the second mailing flap 5.

EXAMPLE 19

FIGS. 61*a* and 61*b* show the inside and outside of Example 19 of a two way envelope that is similar to Example 13 except that the first mailing flap is a bit longer and includes a perforation and a string 33 or a tear strip 31. FIGS. 62*a* and 62*b* are front views of the envelope showing the perforation and string 33 or a tear strip 31 for opening the envelope after the first mailing. The cross section of FIG. 62*a* or 62*b* would look like the envelope shown in FIG. 39 except that the first mailing flap 4 would be a little longer to accommodate the perforation and string 33 or the tear strip 31.

The second mailing flap 5 would be folded outwards away from the envelope as shown in FIG. 38. Likewise the glue is provided in the same position as shown in Example 13.

The first mailing flap 4 includes moisture sensitive glue 27 as opposed to removable glue spots and a portion of the first mailing flap 4 would remain on the front panel 1 once the flap 4 was severed. The front view of the second mailing would look like the envelope shown in FIG. 49.

EXAMPLE 20

FIGS. 63*a* and 63*b* show the inside and outside of Example 20 of a two way envelope that is similar to Example 19 except that the second mailing flap 5 folded inward toward the envelope as opposed to away from the envelope. The cut away view of the envelope showing the second mailing flap 5 folded inward toward the envelope would look the same as the envelope shown in FIG. 43. Examples 19 and 20 are similar in the same way that FIGS. 13 and 14 are similar including the location of the removable glue spots 25 on the second mailing flap 5.

EXAMPLES 21–29

Examples 21–29 are shown in FIGS. 64*a*–85*b*. In each of the examples 21–29, the second mailing flap 5 is integrated with the front panel 1. The first mailing return addresser 10 is provided on the first mailing flap 4. After the first mailing, the envelope is opened, the first mailing flap 4 is tucked inside the envelope. Then the second mailing flap 5 is used to seal the envelope for the second mailing.

EXAMPLE 21

Figures 65, 67, 70, 72, 75, 77, 78A, 78B, 80, 81A, 81B, 82:
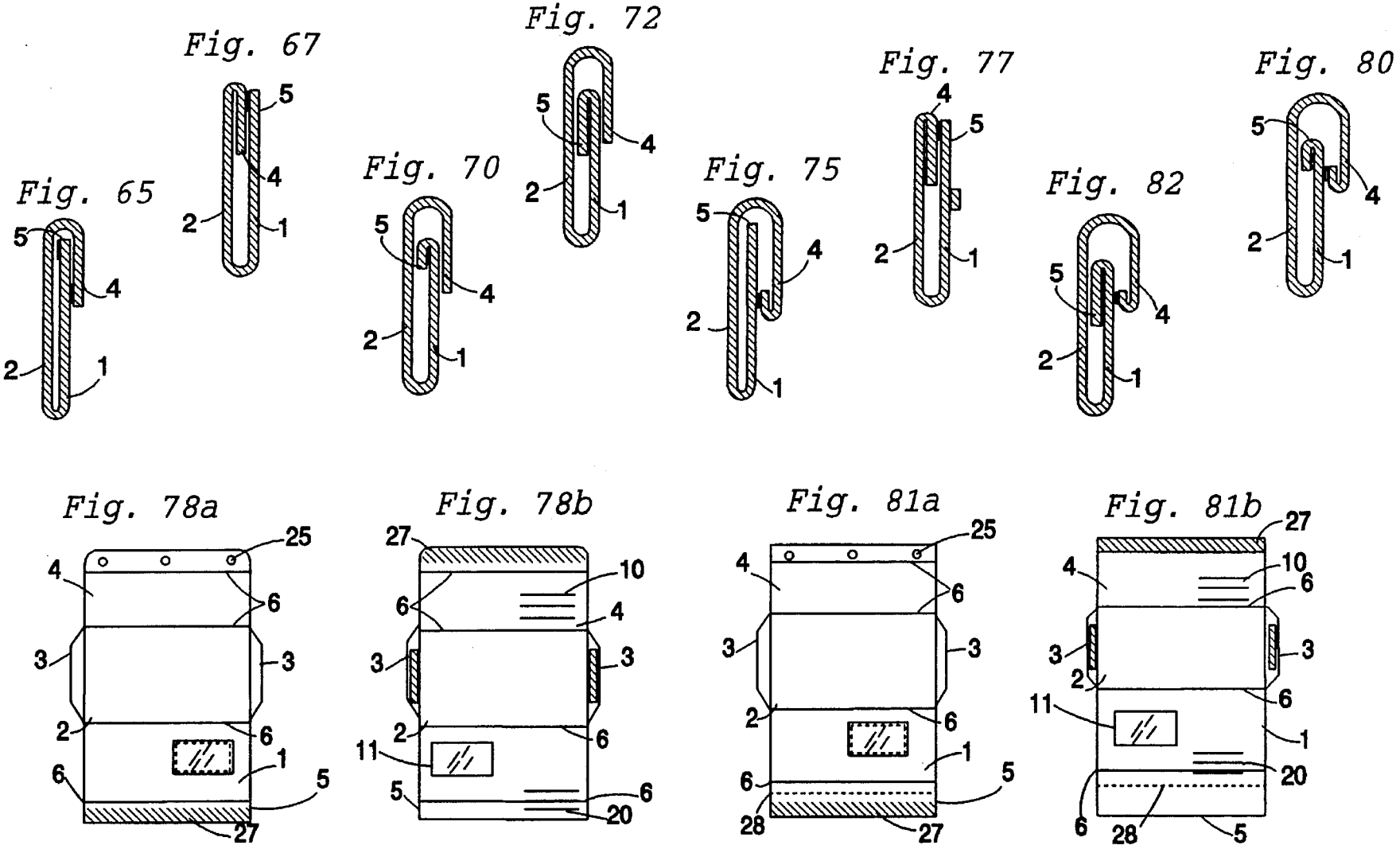
FIG. 65 is a cross sectional view through the envelope shown in FIGS. 64*a* and 64*b* that shows the sealed envelope during the first mailing.
FIG. 67 is a cross sectional view through the envelope shown in FIG. 66 that shows the envelope sealed for the second mailing.
FIG. 70 is a cross sectional view through the envelope shown in FIG. 69 that shows the sealed envelope during the first mailing.
FIG. 72 is a cross sectional view through the envelope shown in FIGS. 71*a* and 71*b* that shows the sealed envelope during the first mailing.
FIG. 75 is a cross sectional view through the envelope shown in FIG. 74 that shows the sealed envelope during the first mailing.
FIG. 77 is a cross sectional view through the envelope shown in FIG. 76 that shows the envelope sealed for the second mailing.
FIGS. 78*a* and 78*b* show the inside and outside of Example 25 of a two way envelope that has a second mailing flap that is integrated with the front panel.
FIG. 80 is a cross sectional view through the envelope shown in FIG. 79 that shows the sealed envelope during the first mailing.
FIGS. 81*a* and 81*b* show the inside and outside of Example 26 of a two way envelope that has a second mailing flap that is integrated with the front panel.
FIG. 82 is a cross sectional view through the envelope shown in FIGS. 81*a* and 81*b* that shows the sealed envelope during the first mailing.

FIGS. 64*a* and 64*b* show the inside and outside of Example 21 of a two way envelope. The second mailing flap 5 is provided on the top portion of the front panel 1. The front view of the envelope would look the same as the envelope shown in FIG. 37. FIG. 65 is a cross sectional view through the envelope that shows the sealed envelope during the first mailing. This envelope looks like a regular envelope through the cross-section, however, the first mailing information is provided on the side that would be the back of a regular envelope.

FIG. 66 is front view of the envelope that has been sealed for the second mailing. FIG. 67 is a cross sectional view through the envelope shown in FIG. 66 that shows the first mailing flap 4 tucked inside the envelope. The first mailing flap 4 is shown with removable glue spots 25 and could include a fold or a perforation parallel to the top edge in the middle of the flap 4 to allow it to tucked inside the envelope more easily. The second mailing flap 5 has moisture sensitive glue 27 for sealing for the second mailing.

EXAMPLE 22

Figure 69:
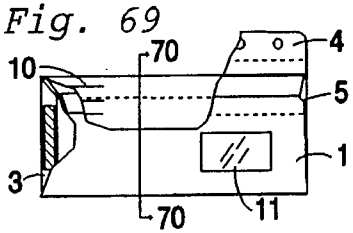
FIG. 69 is a cut away view of the two way envelope showing the second mailing flap on the inside of the envelope and folded inward toward the envelope.
Figure 68B:
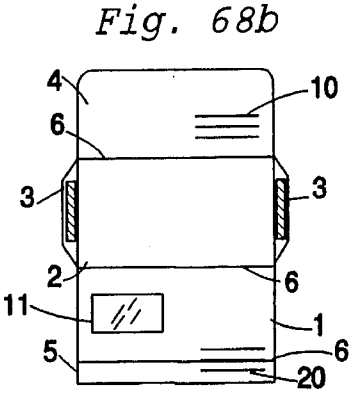
FIGS. 68*a* and 68*b* show the inside and outside of Example 22 of a two way envelope that has a second mailing flap that is integrated with the front panel and folds inside the envelope.
Figure 68A:
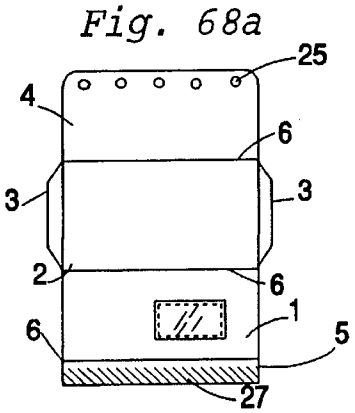

FIGS. 68*a* and 68*b* show the inside and outside of Example 22 of a two way envelope that has a second mailing flap 5 that is integrated with the front panel 1 and folds inside the envelope. Example 22 is the same as the example 21 except the second mailing flap 5 is folded inward. FIG. 69 is a cut away view of the two way envelope showing the second mailing flap 5 on the inside of the envelope and folded inward toward the envelope. FIG. 70 is a cross sectional view through the envelope that shows the sealed envelope during the first mailing.

EXAMPLE 23

Figure 71B:
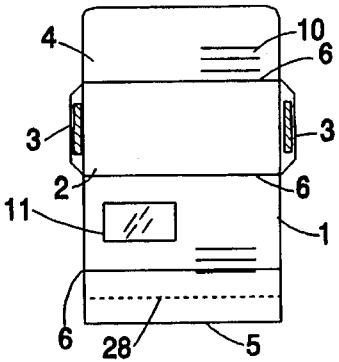
FIGS. 71*a* and 71*b* show the inside and outside of Example 23 of a two way envelope that has a second mailing flap that is integrated with the front panel and folds inside the envelope.
Figure 71A:
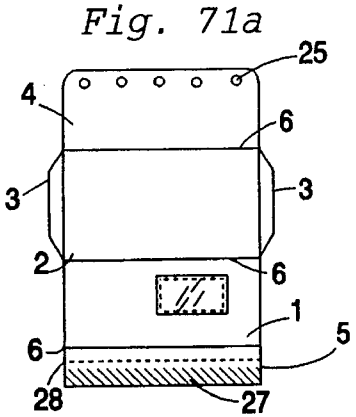

FIGS. 71*a* and 71*b* show the inside and outside of Example 23 a two way envelope that has a second mailing flap 5 that is integrated with the front panel 1 and folds inside the envelope. Example 23 is the same as example and 22 except the second mailing flap is a little longer and seals on the rear panel 2 of the envelope during the second mailing. FIG. 72 is a cross sectional view through the envelope that shows the sealed envelope during the first mailing. The second mailing flap 5 folds over the top of the envelope during the second mailing, along perforation 28. The front view and cross-section of the envelope during second mailing would look like the envelope shown in FIGS. 40 and 41.

EXAMPLE 24

Figure 73B:
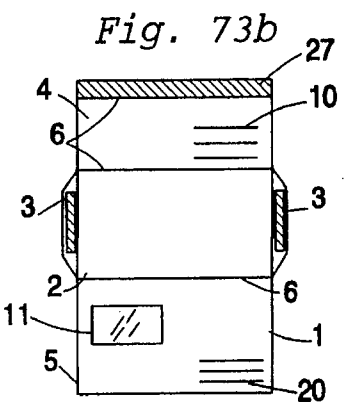
FIGS. 73*a* and 73*b* show the inside and outside of Example 24 of a two way envelope that has a second mailing flap that is integrated with the front panel.
Figure 73A:
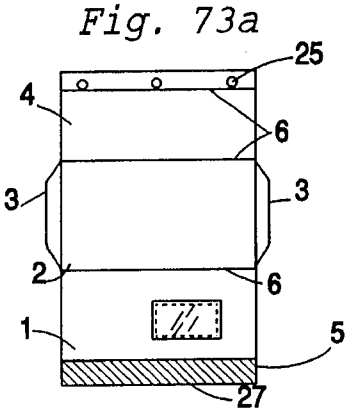
Figure 74:
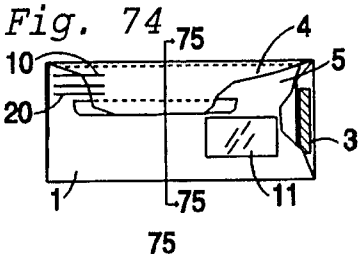
FIG. 74 is a cut away view of the two way envelope showing the first mailing flap folded toward the envelope and sealed.

FIGS. 73*a* and 73*b* show the inside and outside of Example 24 of a two way envelope that has a second mailing flap that is integrated with the front panel. Example 24 is the same as Example 21 except that the first mailing flap 4 is folded at the top and can include notches 32 or a tear strip 31. The front view of the envelope would look the same as the envelopes shown in FIGS. 37, 46*a* and 46*b*. FIG. 74 is a cut away view of the envelope showing the first mailing flap 4 folded toward the envelope and sealed. FIG. 75 is a cross sectional view through the envelope that shows the sealed envelope during the first mailing.

Figure 76:
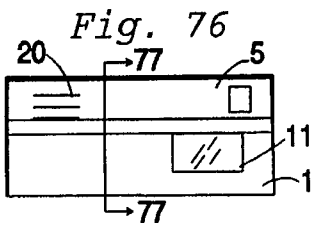
FIG. 76 is front view of the two way envelope that has been sealed for the second mailing.

FIG. 76 is front view of the envelope that has been sealed for the second mailing showing that a portion of the first mailing flap 4 remains on the front panel 4 of the envelope. The first mailing flap would use moisture sensitive glue 27 to seal the envelope, and may include removable glue spots 25 to aid in folding. FIG. 77 is a cross sectional view through the envelope that shows the envelope sealed for the second mailing.

EXAMPLE 25

Figure 79:
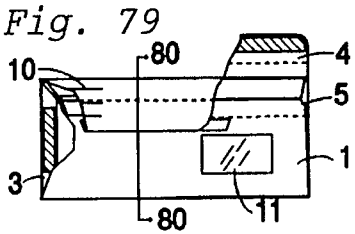
FIG. 79 is a cut away view of the two way envelope showing the second mailing flap folded inside the envelope and the first mailing flap folded toward the envelope and sealed.

FIGS. 78*a* and 78*b* show the inside and outside of Example 25 a two way envelope that has a second mailing flap that is integrated with the front panel. Example 25 is the same as Example 22 except that the first mailing flap 4 is folded at the top and can include notches 32 or a tear strip 31 in the same way Example 24 is similar to Example 21. The front view of the envelope would look the same as the envelopes shown in FIGS. 37, 46*a* and 46*b*. FIG. 79 is a cut away view of the envelope showing the second mailing flap 5 folded inside the envelope and the first mailing flap 4 folded toward the envelope and sealed. FIG. 80 is a cross sectional view through the envelope that shows the sealed envelope during the first mailing. The front view and cross-section of the envelope during second mailing would look the same as the envelope shown in FIGS. 76 and 77.

EXAMPLE 26

FIGS. 81*a* and 81*b* show the inside and outside of Example 26 a two way envelope that has a second mailing flap that is integrated with the front panel. Example 26 is the same as Example 23 except that the first mailing flap 4 is folded at the top and can include notches 32 or a tear strip 31 in the same way Example 24 is similar to Example 21. The front view of the envelope would look the same as the envelopes shown in FIGS. 37, 46*a* and 46*b*. FIG. 82 is a cross sectional view through the envelope that shows the sealed envelope during the first mailing. The front view and cross-section of the envelope during second mailing would look the same as the envelope shown in FIGS. 49 and 50.

EXAMPLE 27

FIGS. 83*a* and 83*b* show the inside and outside of Example 27 of a two way envelope that has a second mailing flap 5 that is integrated with the front panel 1 and the first mailing flap 4 includes a perforation and a string 33. Example 27 is the same as Example 21 except that the first mailing flap 4 is a little longer and includes a perforation and a string 33. The front view of the envelope would look the same as the envelopes shown in FIGS. 62*a* and 62*b*. The cross sectional view through the envelope that shows the sealed envelope during the first mailing would look the same as the envelope shown in FIG. 65.

The front view of the envelope during the second mailing would look the same as the envelope shown in FIG. 76 which shows that a portion of the first mailing flap 4 remains on the front panel 4 of the envelope. The first mailing flap would use moisture sensitive glue 27 to seal the envelope, and may include removable glue spots 25 to aid in folding. The cross sectional view through the envelope that shows the envelope sealed for the second mailing would look the same as the envelope shown in FIG. 77.

EXAMPLE 28

FIGS. 84*a* and 84*b* show the inside and outside of Example 28 of a two way envelope that has a second mailing flap 5 that is integrated with the front panel 1 and the first mailing flap 4 includes a perforation and a string 33. Example 28 is the same as Example 22 except that the first mailing flap 4 is a little longer and includes a perforation and a string 33 in the same way Example 27 is similar to Example 21. The front view of the envelope would look the same as the envelopes shown in FIGS. 62*a* and 62*b*. The cross sectional view through the envelope that shows the sealed envelope during the first mailing would look the same as the envelope shown in FIG. 70. The front view and cross-section of the envelope during second mailing would look the same as the envelope shown in FIGS. 40 and 41.

EXAMPLE 29

FIGS. 85*a* and 85*b* show the inside and outside of Example 29 of a two way envelope that has a second mailing flap 5 that is integrated with the front panel 1 and the first mailing flap 4 includes a perforation and a string 33. Example 29 is the same as Example 23 except that the first mailing flap 4 is a little longer and includes a perforation and a string 33 in the same way Example 28 is similar to Example 22. The front view of the envelope would look the same as the envelopes shown in FIGS. 62*a* and 62*b*. The cross sectional view through the envelope that shows the sealed envelope during the first mailing would look the same as the envelope shown in FIG. 72. The front view and cross-section of the envelope during second mailing would look the same as the envelope shown in FIGS. 49 and 50.

EXAMPLES 30–41

Examples 30–41 of two way envelopes are shown in FIGS. 86*a* through 130. In each of the examples 30–41, the second mailing flap 5 is attached to the first mailing flap 4. The first mailing flap 4 is attached to the rear panel 2. The first mailing flap 4 is severed during opening and the second mailing flap 5 provides new information for the second mailing. The first mailing return addresser 10 is provided on the first mailing flap 4.

EXAMPLE 30

Figures 87, 88, 89, 90, 91A, 91B, 92, 93, 95, 96, 97, 98:
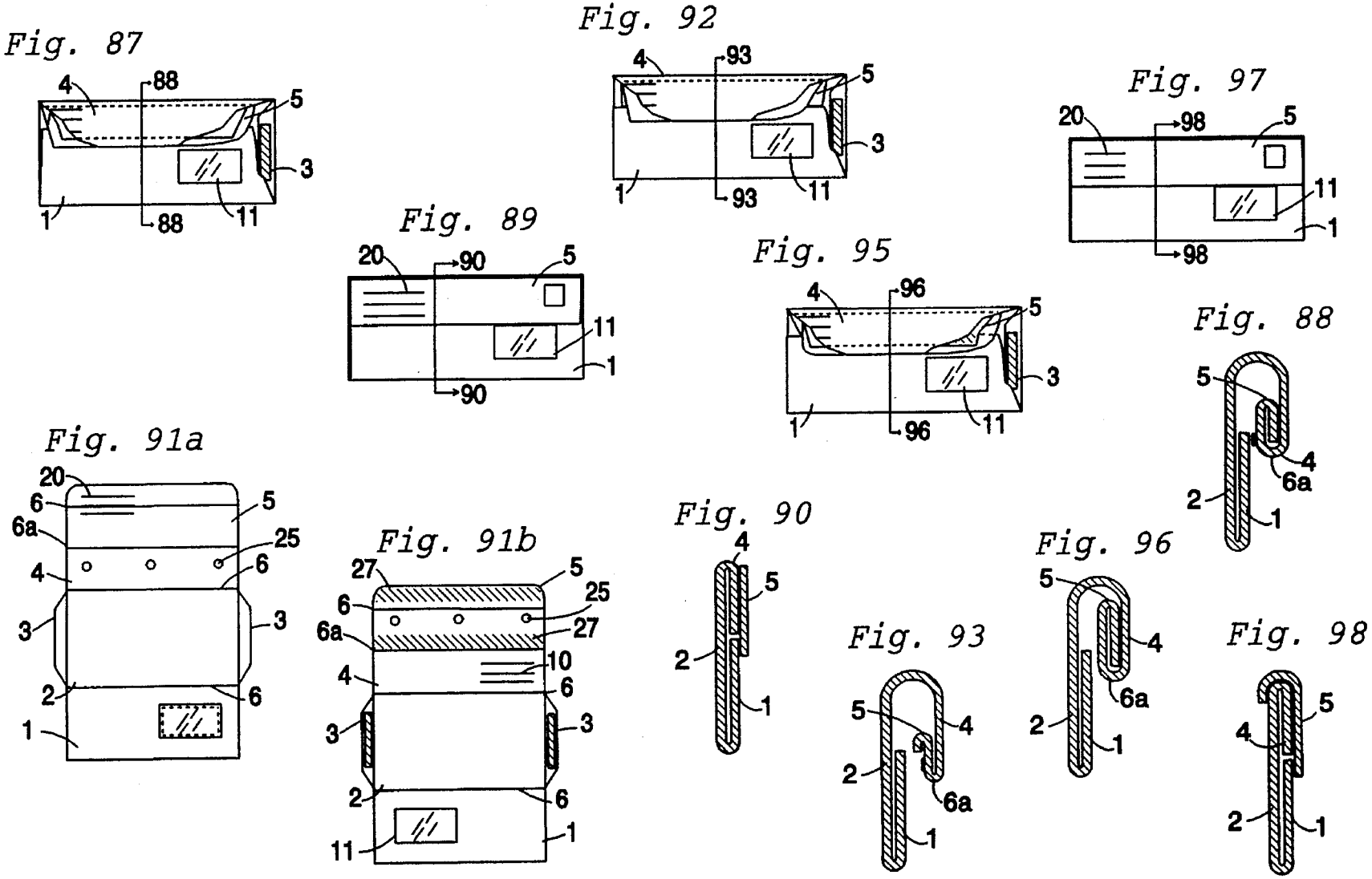
FIG. 87 is a cut away view of the two way envelope showing the second mailing flap folded outside the envelope away from the envelope.
FIG. 88 is a cross sectional view through the envelope shown in FIG. 87 that shows the sealed envelope during the first mailing.
FIG. 89 is front view of the two way envelope that has been sealed for the second mailing.
FIG. 90 is a cross sectional view through the envelope shown in FIG. 89 that shows the envelope sealed for the second mailing.
FIGS. 91*a* and 91*b* show the inside and outside of Example 31 of a two way envelope that has a second mailing flap that is integrated with the first mailing flap.
FIG. 92 is a cut away view of the two way envelope showing the second mailing flap folded outside the envelope toward the envelope.
FIG. 93 is a cross sectional view through the envelope shown in FIG. 92 that shows the sealed envelope during the first mailing.
FIG. 95 is a cut away view of the two way envelope showing the second mailing flap folded outside the envelope away from the envelope.
FIG. 96 is a cross sectional view through the envelope shown in FIG. 95 that shows the sealed envelope during the first mailing.
FIG. 97 is front view of the two way envelope that has been sealed for the second mailing.
FIG. 98 is a cross sectional view through the envelope shown in FIG. 97 that shows the envelope sealed for the second mailing.

FIGS. 86*a* and 86*b* show the inside and outside of Example 30 of a two way envelope that has a second mailing flap 5 that is integrated with the first mailing flap 4. The first mailing flap 4 can include a perforation, a perforation and a string 33, notches 32 or a tear strip 31 to make opening the envelope after the first mailing easier. The front view of the envelope during first mailing would look like the envelopes shown in FIGS. 37, 46*a* and 46*b*. The first mailing flap 4 is attached to the rear panel 2. The second mailing flap 5 is attached to the first mailing flap 4 and includes a fold between the flap 5 and the first mailing flap 4 and another fold in the middle of the flap 5. FIG. 87 is a cut away view of the envelope showing the second mailing flap 5 folded outside the envelope away from the envelope. FIG. 88 is a cross sectional view through the envelope that shows the sealed envelope during the first mailing.

The second mailing flap 5 includes moisture sensitive glue 27 on the outside of the flap 5 adjacent to the first mailing flap 4 such that when the flap 5 is folded the glue 27 can seal the envelope during the first mailing. After the first mailing the first mailing flap 4 is severed from the second mailing flap 5 along fold 6*a*. The second mailing flap 5 is folded over the top of the envelope and sealed with the moisture sensitive glue 27 provided at the top of the flap 5. The second mailing return addresser 20 is provided on the second mailing flap 5. FIG. 89 is front view of the envelope that has been sealed for the second mailing. FIG. 90 is a cross sectional view through the envelope that shows the envelope sealed for the second mailing. Removable glue spots 25 can be added to make the folding of the second mailing flap 5 easier.

EXAMPLE 31

FIGS. 91*a* and 91*b* show the inside and outside of Example 31 of a two way envelope that has a second mailing flap that is integrated with the first mailing flap. Example 31 is the same as Example 30 except that second mailing flap 5 is folded toward the envelope rather than away from the envelope during the first mailing. FIG. 92 is a cut away view of the envelope showing the second mailing flap 5 folded outside the envelope toward the envelope. FIG. 93 is a cross sectional view through the envelope that shows the sealed envelope during the first mailing. The removable glue spots 25 provided on the second mailing flap 5 are on the outside of the envelope rather than on the inside. The front view during the first mailing and the front view and cross sectional view during second mailing would look the same as Example 30.

EXAMPLE 32

FIGS. 94*a* and 94*b* show the inside and outside of Example 32 of a two way envelope that has a second mailing flap 5 that is integrated with the first mailing flap 4. Example 32 is the same as Example 30 except that the second mailing flap 5 is slightly larger and folds over the top of the envelope during second mailing. FIG. 95 is a cut away view of the envelope showing the second mailing flap 5 folded outside the envelope away from the envelope. FIG. 96 is a cross sectional view through the envelope that shows the sealed envelope during the first mailing. FIG. 97 is front view of the envelope that has been sealed for the second mailing. FIG. 98 is a cross sectional view through the envelope that shows the envelope sealed for the second mailing.

EXAMPLE 33

FIGS. 99*a* and 99*b* show the inside and outside of Example 33 of a two way envelope that has a second mailing flap 5 that is integrated with the first mailing flap 4. Example 33 is the same as Example 31 except that the second mailing flap 5 is slightly larger and folds over the top of the envelope during second mailing. FIG. 100 is a cross sectional view through the envelope that shows the sealed envelope during the first mailing showing the second mailing flap 5 folded outside the envelope toward the envelope. The front view and cross sectional view of the envelope during the second mailing would look the same as the envelope shown in FIGS. 97 and 98.

EXAMPLE 34

Figure 103:
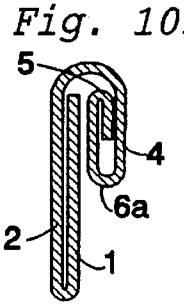
FIG. 103 is a cross sectional view through the envelope shown in FIG. 102 that shows the sealed envelope during the first mailing.

FIGS. 101*a* and 101*b* show the inside and outside of Example 34 of a two way envelope that has a second mailing flap 5 that is integrated with the first mailing flap 4. The front view of the envelope during first mailing would look like the envelope shown in FIG. 37. The first mailing flap 4 is attached to the rear panel 2. The second mailing flap 5 is attached to the first mailing flap 4 and includes a fold between the flap 5 and the first mailing flap 4 and another fold in the middle of the flap 5. FIG. 102 is a cut away view of the envelope showing the second mailing flap 5 folded outside the envelope away from the envelope. FIG. 103 is a cross sectional view through the envelope that shows the sealed envelope during the first mailing.

The second mailing flap 5 includes moisture sensitive glue 27 on the outside of the flap 5 adjacent to the first mailing flap 4 such that when the flap 5 is folded the glue 27 can seal the envelope during the first mailing. During the first mailing, the second mailing return addresser 20 is hidden by the flaps 4 and 5. After the first mailing the first mailing flap 4 is severed from the second mailing flap 5. The second mailing flap 5 is folded down over the first mailing forward addresser 11 and sealed with the moisture sensitive glue 27 provided at the top of the inside of flap 5. A perforation or fold 40 can be provided to make folding the second mailing flap 5 down easier. The second mailing forward addresser 21 is provided on the second mailing flap 5. The first mailing flap 4 is removed from the envelope or tucked into the inside of the envelope and moisture sensitive glue 27 is provided on the top of the inside of the front panel 1 for resealing the envelope for the second mailing. Once the first mailing flap 4 is removed or tucked inside the envelope and the second mailing flap 5 is folded down, the second mailing return addresser 20 is no longer hidden. FIG. 104 is front view of the envelope that has been sealed for the second mailing. FIG. 105 is a cross sectional view through the envelope that shows the envelope sealed for the second mailing. Removable glue spots 25 can be added to make the folding of the second mailing flap 5 easier.

EXAMPLE 35

Figure 106B:
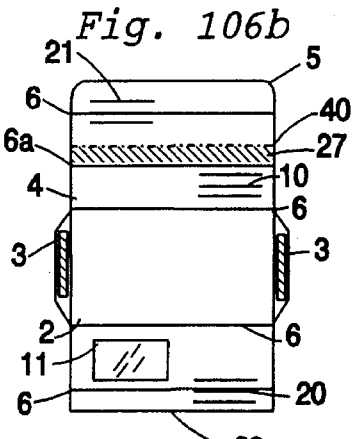
FIGS. 106*a* and 106*b* show the inside and outside of Example 35 of a two way envelope that has a second mailing flap that is integrated with the first mailing flap.
Figure 106A:
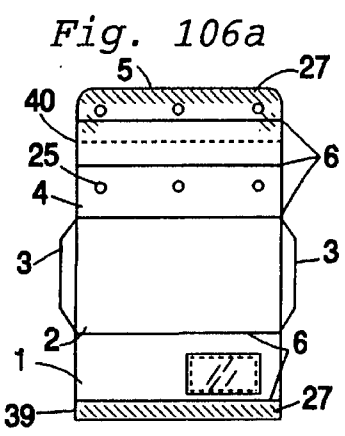
Figure 108:
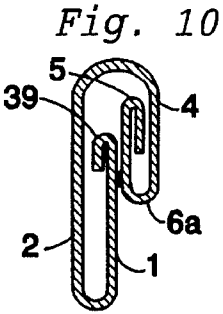
FIG. 108 is a cross sectional view through the envelope shown in FIG. 107 that shows the sealed envelope during the first mailing.
Figure 107:
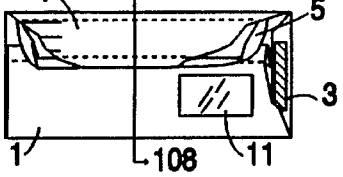
FIG. 107 is a cut away view of the two way envelope showing the second mailing flap folded outside the envelope away from the envelope and the front panel folded inside the envelope.

FIGS. 106*a* and 106*b* show the inside and outside of Example 35 of a two way envelope that has a second mailing flap 5 that is integrated with the first mailing flap 4. Example 35 is the same as Example 34 except that a portion of the front panel is folded over to provide a second sealing flap 39. FIG. 107 is a cut away view of the envelope showing the second mailing flap 5 folded outside the envelope away from the envelope and the front panel 1 folded inside the envelope. FIG. 108 is a cross sectional view through the envelope that shows the sealed envelope during the first mailing. After the first mailing the second sealing flap 39 would be folded up and used to reseal the envelope. The front and cross sectional views during the second mailing would look the same as the envelope shown in FIGS. 104 and 105.

EXAMPLE 36

Figure 109B:
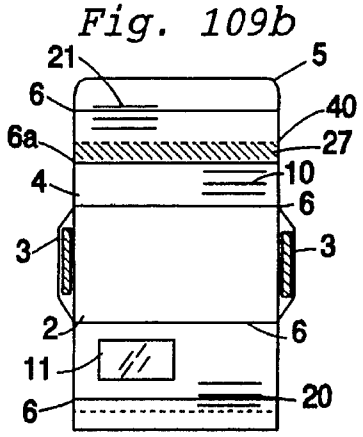
FIGS. 109*a* and 109*b* show the inside and outside of Example 36 of a two way envelope that has a second mailing flap that is integrated with the first mailing flap.
Figure 109A:
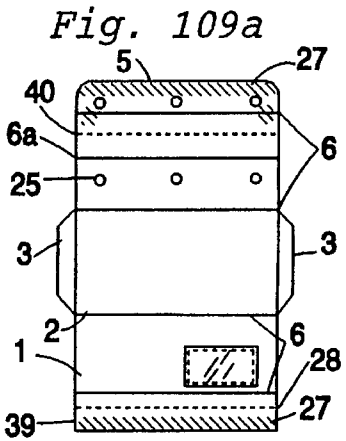
Figure 113:
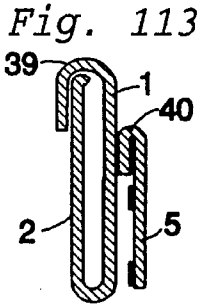
FIG. 113 is a cross sectional view through the envelope shown in FIG. 112 that shows the envelope sealed for the second mailing.
Figure 111:
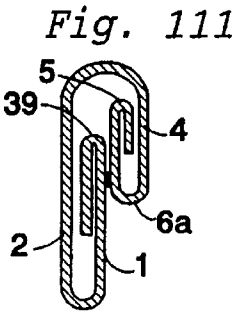
FIG. 111 is a cross sectional view through the envelope shown in FIG. 110 that shows the sealed envelope during the first mailing.
Figure 112:
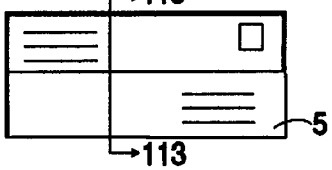
FIG. 112 is front view of the two way envelope that has been sealed for the second mailing.
Figure 110:
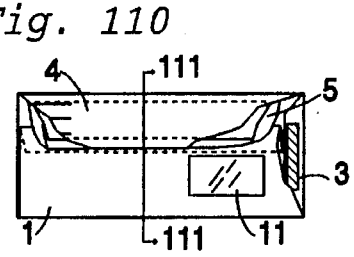
FIG. 110 is a cut away view of the two way envelope showing the second mailing flap folded outside the envelope away from the envelope and the front panel folded inside the envelope.

FIGS. 109*a* and 109*b* show the inside and outside of Example 36 of a two way envelope that has a second mailing flap 5 that is integrated with the first mailing flap 4. Example 36 is the same as Example 35 except that the second sealing flap 39 is longer and folds over the top of the envelope during the second mailing. FIG. 110 is a cut away view of the envelope showing the second mailing flap 5 folded outside the envelope away from the envelope and the second sealing flap 39 that is attached to the front panel 1 folded inside the envelope. FIG. 111 is a cross sectional view through the envelope that shows the sealed envelope during the first mailing. FIGS. 112 and 113 are a front view and cross sectional view of the envelope that has been sealed for the second mailing showing the second sealing flap 39 folded over the top of the envelope. The second sealing flap 39 can include a fold or perforation to allow the flap 39 to fold over the top of the envelope more easily. As is shown, the first mailing flap 4 can be removed after the first mailing.

EXAMPLE 37

FIGS. 114*a* and 114*b* show the inside and outside of Example 37 of a two way envelope that has a second mailing flap 5 that is integrated with the first mailing flap 5 and a second sealing flap 39 attached to the front panel 1. Example 37 is the same as Example 36 except the second sealing flap 39 folds on the outside of the envelope during the first mailing. The front view of the envelope during first mailing would look the same as the envelope shown in FIG. 37. FIG. 115 is a cut away view of the envelope showing the second mailing flap 5 folded outside the envelope away from the envelope and the second sealing flap 39 folded outside the envelope away from the envelope. FIG. 116 is a cross sectional view through the envelope that shows the sealed envelope during the first mailing. The second sealing flap 39 has the second mailing return addresser 20. The front view and cross sectional view during the second mailing would look the same as the envelope shown in FIGS. 112 and 113.

EXAMPLE 38

FIGS. 117*a* and 117*b* show the inside and outside of Example 38 of a two way envelope that has a second mailing flap 5 that is integrated with the first mailing flap 4 and a second sealing flap 39 attached to the front panel 1. Example 38 is the same as Example 37 except the second sealing flap 39 is folded toward the envelope rather than away from the envelope. FIG. 118 is a cut away view of the envelope showing the second mailing flap 5 folded outside the envelope away from the envelope and the second sealing flap 39 folded outside the envelope toward the envelope. FIG. 119 is a cross sectional view through the envelope that shows the sealed envelope during the first mailing.

EXAMPLE 39

FIGS. 120*a* and 120*b* show the inside and outside of Example 39 of a two way envelope that has a second mailing flap 5 that is integrated with the first mailing flap 4 and a second sealing flap 39 attached to the front panel 1. The second mailing flap 5 is actually the back of the first mailing flap 4. A pressure sensitive adhesive strip 35 is provided on the bottom of the front panel 1. The front view of the envelope during the first mailing would look like the envelope shown in FIG. 55. FIG. 121 is a cut away view of the envelope showing the second sealing flap 39 folded inside the envelope. The first and second mailing flaps 4 and 5 include a fold 6 near the top. The top of the flaps 4 and 5 is folded over and can be held in place with removable glue spots 25. Moisture sensitive glue 27 is provided on the top of the first mailing flap 4 and is used to seal the envelope for the first mailing. FIG. 122 is a cross sectional view through the envelope that shows the sealed envelope during the first mailing.

After the first mailing, the first mailing flap 4 is separated from the rear panel 2 and is folded down over the first mailing forward addresser 11. The second mailing forward addresser is provided on the second mailing flap 5 which is merely the back of the former first mailing flap 4. The second mailing forward addresser 21 is provided on the second sealing flap 39. The front view during the second mailing looks the same as the envelope shown in FIG. 112. FIG. 123 is a cross sectional view through the envelope that shows the envelope sealed for the second mailing.

EXAMPLE 40

FIGS. 124*a* and 124*b* show the inside and outside of Example 40 of a two way envelope that has a second mailing flap 5 that is integrated with the first mailing flap 4 and a second sealing flap 39 attached to the second mailing flap 5. The second mailing flap 5 is actually the back of the first mailing flap 4. A pressure sensitive adhesive strip 35 is provided on the bottom of the front panel 1. The front view of the envelope during the first mailing would look like the envelope shown in FIG. 55. FIG. 125 is a cut away view of the envelope showing the second mailing flap 5 and the second sealing flap 39 folded outside the envelope toward the envelope. FIG. 126 is a cross sectional view through the envelope that shows the sealed envelope during the first mailing.

After the first mailing, the first mailing flap 4 is separated from the rear panel 2 and is folded down over the first mailing forward addresser 11. The second mailing forward addresser 21 is provided on the second mailing flap 5 which is merely the back of the former first mailing flap 4. The second mailing return addresser 20 is provided on the second sealing flap 39 which folds up and over the envelope and seals on the rear panel 2 for the second mailing. The front view during the second mailing looks the same as the envelope shown in FIG. 4. FIG. 127 is a cross sectional view through the envelope that shows the envelope sealed for the second mailing.

EXAMPLE 41

FIGS. 128*a* and 128*b* show the inside and outside of Example 41 of a two way envelope that has a second mailing flap 5 that is integrated with the first mailing flap 4 and a second sealing flap 39 attached to the second mailing flap 5. Example 41 is the same as example 40 except that the second sealing flap 39 is folded away from the envelope rather than towards the envelope. FIG. 129 is a cut away view of the envelope showing the second mailing flap 5 and the second sealing flap 39 folded outside the envelope away from the envelope. FIG. 130 is a cross sectional view through the envelope that shows the sealed envelope during the first mailing.

It is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. An envelope that can he used for a first and second mailing, comprising:

a) a front panel having an inner and outer surface with a first mailing forward addresser and at least a portion of a second mailing return addresser on said outer surface;

b) a rear panel having an inner and outer surface extending from and adhered to said front panel to form a rectangular enclosure that is closed completely on one side, partially closed on two opposite sides and open on one side to allow insertion of correspondence into the envelope;

c) a first mailing flap extending from said rear panel along said side forming said opening in said enclosure and having an inner and outer surface with a first mailing return addresser on said outer surface and an adhesive on a portion of said flap such that said first mailing flap can be folded over the open side of said enclosure formed by said front and rear panels and be adhered to said front panel to seal the envelope for first mailing; and d) a second mailing flap extending from said front panel along said side forming said opening in said enclosure and folded upon itself, wherein said second mailing flap has an inner and outer surface, adhesive on at least a portion of said inner surface and said second mailing flap is concealed during a first mailing and second mailing return addresser is displayed when said second mailing flap is unfolded and adhered over the outer surface of said rear panel.

2. The envelope of claim 1 wherein said second mailing flap includes a fold guide just above and parallel to where said second mailing flap attaches to said front panel so that when said second mailing flap is unfolded and sealed on said rear panel said first mailing flap can be inserted into said enclosure and said fold guide will provide a fold in said second mailing flap that makes the envelope slightly taller to accommodate the insertion of said first mailing flap into said enclosure.

3. The envelope of claim 1 wherein said second mailing flap is folded inward and rests in said unclosed portion of said partially closed sides during said first mailing.

4. The envelope of claim 3 wherein said second mailing flap is folded such that said adhesive portion does not come into contact with said rear panel prior to said second mailing.

5. The envelope of claim 1 wherein said second mailing flap is folded to rest against the outer surface of said front panel and is covered by said first mailing flap during said first mailing.

6. The envelope of claim 5 wherein said second mailing flap is folded such that said adhesive portion does not come into contact with said first mailing panel during said first mailing.

7. The envelope of claim 1 wherein said first mailing flap includes a fold near the edge of said first mailing flap parallel to and furthest from the edge where said first mailing mailing flap extends from said rear panel such that said adhesive portion is on the outer surface of said folded portion of said first mailing flap.

8. The envelope of claim 7 further comprising:

1) a covered adhesive strip on said outer surface of said front panel along said edge that is parallel to and furthest from the edge forming said opening in said enclosure, and 2) a second mailing forward addresser on said inner surface of said first mailing flap, wherein said first mailing flap can be severed along the edge where said first mailing flap extends from said rear panel and said adhesive strip can be uncovered such that said first mailing flap can be folded down and adhered to said uncovered strip to display said second mailing forward addresser.

9. The envelope of claim 1 wherein said adhesive portion is on said inner surface of said first mailing flap along the edge parallel to and furthest from the edge where said first mailing flap extends from said rear panel.

10. The envelope of claim 1 further comprising side flaps that extend from the partially closed sides of either the front or rear panel and fold inward towards the enclosure and seal to the inner surfaces of the panel opposite to which said side flaps are attached and said side flaps are tapered near the open edge of said enclosure to facilitate insertion of mail into said enclosure.

* * * * *